US011752444B2

(12) United States Patent
Engelhard

(10) Patent No.: US 11,752,444 B2
(45) Date of Patent: Sep. 12, 2023

(54) TOY BUILDING UNIT

(71) Applicant: Teresa Lucille Engelhard, Saint Kilda (AU)

(72) Inventor: Teresa Lucille Engelhard, Saint Kilda (AU)

( * ) Notice: Subject to any disclaimer, the term of this patent is extended or adjusted under 35 U.S.C. 154(b) by 0 days.

(21) Appl. No.: 17/527,884

(22) Filed: Nov. 16, 2021

(65) Prior Publication Data

US 2023/0149827 A1 May 18, 2023

(51) Int. Cl.
*A63H 33/08* (2006.01)

(52) U.S. Cl.
CPC ..... *A63H 33/086* (2013.01)

(58) Field of Classification Search
CPC ..... A63H 33/06; A63H 33/16; A63H 33/086
USPC ..... 446/109, 114, 115, 116, 478, 488
See application file for complete search history.

(56) References Cited

U.S. PATENT DOCUMENTS 595,494 A * 12/1897 O'Meara ..... C21D 9/0025 220/678
1,198,524 A * 9/1916 Cunliffe ..... B65D 7/26 220/6
1,477,255 A * 12/1923 Fritz ..... G09B 17/00 446/109
1,894,061 A * 1/1933 Sanders ..... A63H 33/084 D21/491
2,075,259 A * 3/1937 Battjes ..... A63H 33/06 229/198.2
2,558,591 A * 6/1951 Starck ..... A63H 33/084 217/17
2,814,159 A * 11/1957 Green ..... A63H 33/06 446/69
3,264,021 A * 8/1966 Artman ..... A63H 33/101 403/3
3,368,316 A * 2/1968 Crowder ..... E04B 2/14 52/592.1
3,584,400 A * 6/1971 Voges ..... G09B 27/08 434/135
3,666,607 A * 5/1972 Weissman ..... B65D 5/4275 52/DIG. 10
3,744,700 A * 7/1973 Stegmann ..... B65D 5/324 446/124
3,940,142 A * 2/1976 Hinz ..... A63F 9/0413 446/109
4,380,133 A * 4/1983 Arnstein ..... A63H 33/16 446/488
4,523,418 A * 6/1985 McLaughlin ..... E04H 1/1205 446/478
4,620,842 A * 11/1986 Wang ..... G09B 27/08 434/137
4,836,787 A * 6/1989 Boo ..... A63H 33/048 446/108
5,746,038 A * 5/1998 Houk ..... E04B 1/02 446/116
5,947,741 A * 9/1999 Villarreal ..... G09B 21/009 434/159
6,186,855 B1 * 2/2001 Bauer ..... A63H 33/06 446/104
6,659,459 B2 * 12/2003 Dewa ..... A63F 9/0413 273/148 R (Continued)

*Primary Examiner* — Joseph B Baldori
(74) *Attorney, Agent, or Firm* — DLA PIPER LLP (US)

(57) ABSTRACT

Disclosed herein is a toy building unit for playing capable of folding from a flat position into a three-dimensional hollow position.

17 Claims, 17 Drawing Sheets

(56) References Cited

U.S. PATENT DOCUMENTS

| | | | | |
|---|---|---|---|---|
| 7,798,163 | B2 * | 9/2010 | Yang | A63H 33/008 446/72 |
| 8,544,216 | B1 * | 10/2013 | Hazlett | A63H 33/008 52/270 |
| 10,933,305 | B2 * | 3/2021 | Udo | A63H 33/08 |
| 11,110,368 | B2 * | 9/2021 | Nawracala | B31D 5/04 |
| 11,224,822 | B2 * | 1/2022 | Kolev | A63H 33/16 |
| 2004/0046011 | A1 * | 3/2004 | Lin | A63H 33/16 229/116 |
| 2005/0287906 | A1 * | 12/2005 | He | A63H 33/082 446/109 |

* cited by examiner 108
110
104

FIG. 14A

| | |
|---|---|
| 402 | Obtaining a single sheeting material e.g., cardstock, plastic sheeting, wood sheeting, bagasse, foam sheeting, particle board, vellum paper, cardboard, paper, vinyl sheeting, rubber sheeting and laminates of any of these materials |
| 404 | Cutting a plurality of teeth 112 from the edge of a section 104 of the building unit 100 using die cutting, laser-cutting, or combinations thereof |
| 406 | Forming a plurality of hinges 106 by crease scoring the material and / or forming a plurality of hinges 106 by cut scoring the material using a straight edge |
| 408 | Forming, from the edge of a section 104 of the building unit 100, a plurality of joins 110 using die cutting, laser-cutting, or combinations thereof |
| 410 | Cutting a building unit 100 from the single sheeting material using die cutting, laser-cutting, or combinations thereof |
| 412 | Applying a waterproofing step to the building unit 100 |
| 414 | In some embodiments, the example method of manufacture can be reordered and / or altered to include and / or remove one or more steps |

FIG. 14B

| | |
|---|---|
| 416 | Obtaining for injection molding a material e.g., plastic, bioplastic, rubber, or combinations thereof |
| 418 | Obtaining for wet pressing, dry pressing, transfer molding, thermoforming, or combinations thereof, a material e.g., paper pulp, bagasse pulp, hemp pulp, bamboo pulp, wood pulp, recycles pulp, or combinations thereof, wherein the material can include resins, wax, plastic, bioplastic, or combinations thereof |
| 420 | Forming, by a molding process of a material, a building unit 100 that can include a plurality of sections 104, wherein the plurality of sections 104 can be delineated from and connected to at least one other section 104 with a hinge 106 that is integral to the building unit 100; and a plurality of joins 110 along the outer edges of the building unit 100 |
| 422 | Forming one or more, or a plurality of teeth 112 of a join 110 using injection molding, wet pressing, dry pressing, transfer molding, thermoforming, or combinations thereof |
| 412 | Applying a waterproofing step to the building unit 100 |
| 414 | In some embodiments, the example method of manufacture can be reordered and / or altered to include and / or remove one or more steps |

TOY BUILDING UNIT

BRIEF DESCRIPTION OF THE DRAWINGS

FIG. 14A illustrates an example method of manufacturing the toy building unit, according to aspects of the disclosure.

FIG. 14B illustrates an example method of manufacturing the toy building unit, according to aspects of the disclosure.

DETAILED DESCRIPTION

Figure 1A:
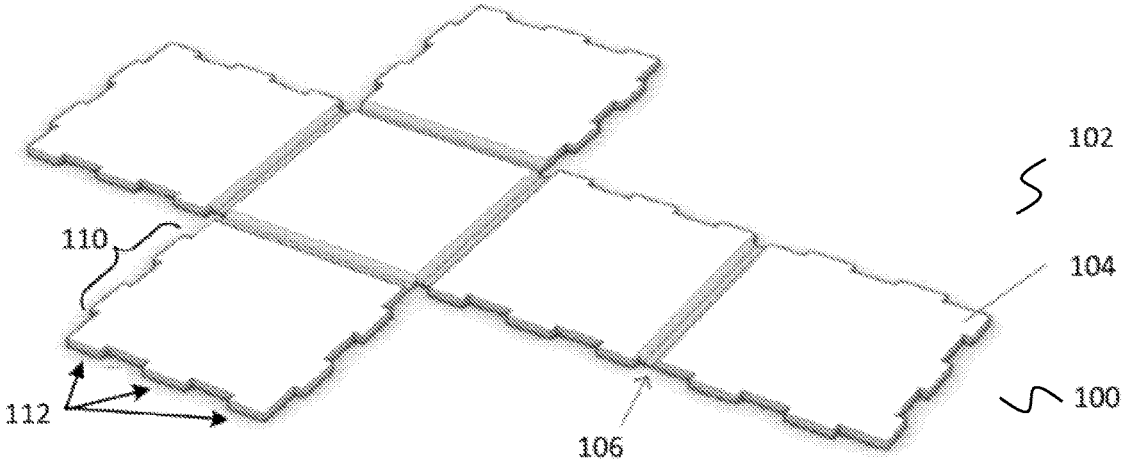
FIG. 1A illustrates a toy building unit in a flat position, according to some aspects of the disclosure.

Provided herein is a toy building unit for playing capable of folding from a flat position into a three-dimensional hollow position held together only by friction and methods of manufacturing the same.

In some embodiments, the building unit 100 can be in a flat position 102, a partially constructed position, a three-dimensional hollow position 108, a closed position, or an open position. In some embodiments, the building unit 100 in a closed position can be the building unit in a three-dimensional hollow position 108. In some embodiments, the building unit 100 in an open position can be the building unit 100 in a partially constructed position such that at least one section 104 has an edge which is a join 110 that is not paired with (e.g., not connected with) another join 110. In some embodiments, closure of the building unit 100 (e.g., the building unit in a partially constructed position or a three-dimensional hollow position 108), can provide structural rigidity.

In some embodiments, the building unit 100 can include a plurality of sections 104. In some embodiments, the building unit 100 can include 3 to tens, or any value or range between, or more sections 104. In some embodiments, the sections 104 can be, but are not limited to, square, rectangular, semicircular, triangular, oblong, pentagonal, hexagonal, diamond, trapezoidal, octagonal, or any other suitable shape. In some embodiments, the sections 104 can be rigid, flexible, or pliable, or capable of forming an arc. In some embodiments, the plurality of sections 104 can be delineated from and connected to at least one other section 104. In some embodiments, a section 104 can be connected to another section 104 by at least one hinge 106. In some embodiments the at least one hinge 106 is integral to the building unit 100. In some embodiments, integral can mean that the sections and the hinges are one piece a same material. In some embodiments, integral can mean that the building unit 100 can be made such that all of the sections and all of the hinges are made of one material that can start in a flat or two-dimensional position and fold into a three-dimensional hollow position 108. In some embodiments, integral can mean that hinges 106 can be part of the building unit 100 and can be manufactured in one piece of a same material, as shown in FIGS. 1-2, 3C, 4-9. In some embodiments, a section 104 can have an edge. In some embodiments, the edge of a section 104 can be on an outside perimeter of the toy building unit 100. In some embodiments, at least one edge of a section 104 can be a join 110.

In some embodiments, the building unit 100 can include a plurality of hinges 106. In some embodiments, the hinge 106 can be integral to the building unit 100. In some embodiments, the hinge 110 can be a living hinge. In some embodiments, the hinge 110 can be a partial cut. In some embodiments, the hinge 110 can be a small indent at a stress point aligned collinearly on the building unit 100 rather than cutting the thickness of the building unit 100 entirely. In some embodiments, the hinge can appear as a groove viewing one surface of the building unit 100 and a ridge when viewing the opposite surface of the building unit 100. In some embodiments, a hinge 106 can connect two sections 104 of the building unit 100. In some embodiments, the hinge 106 can bend to an angle when the building unit is in a three-dimensional hollow position 108. In some embodiments, the angle of the hinge 106 when the building unit is in a closed position 108 can be about a 15° angle to about a 200° angle or any range or value between. In some embodiments, one or more hinge 106 can be removed. In some embodiments, one or more hinge 106 can be removably attached. In some embodiments, one or more hinge of the building unit 100 can be replaced by two joins 110.

In some embodiments, the building unit 100 can include a plurality of joins 110. In some embodiments, the join 110 can be a zip join, a finger join, or any other suitable join. In some embodiment, a join can include one or more teeth. In some embodiments, the joins 110 may be along the perimeter of the building unit 100. In some embodiments, the edges of a section 104 of a building unit 100 can include one or more joins 110 corresponding to one or more edges of the section. In some embodiments two joins 110 may be interleaved. In some embodiments, two joins 110 interleaved can hold together two or more sections 104 of the building unit 100. In some embodiments, two or more joins 110 can be reversibly opened and closed. In some embodiments, joins 110 enable closure of building unit in a three-dimensional hollow position 108. In some embodiments, joins 110 enable partial closure of building unit 100. In some embodiments, two or more joins 110 can be held together by friction. In some embodiments, closure of building unit 100 is enabled by friction among joins 110. In some embodiments, closure of building unit 100 is reversable and repeatable. In some embodiments, joins 110 have no teeth 112, but latching ridge or similar mechanism among joins 110 connect two or more sections 104 of the building unit 100 into a closed position. In some embodiments, joins have one or more teeth 112.

In some embodiments, hinges 106 and joins 110 are features of the building unit 100 when the building unit in a flat position 102 and the building unit in a three-dimensional hollow position 108.

In some embodiments, the building unit 100 can include one or more teeth 112. In some embodiments, the building unit 100 can include one or more teeth at each join 110 outlining the outer edges of sections 104 of the building unit. In some embodiments, join 110 can include the one or more teeth 112. In some embodiments, teeth 112 can be integral to joins 110 and grip one or more opposing teeth 112 (e.g., teeth integral to another join 110 on another different section 104 such that the two joins are paired to form an edge of the building unit in a three-dimensional hollow position 108). In some embodiments a join 110 can include about 0 teeth 112 to about 100 teeth 112 or any range or value between. In some embodiments the teeth 112 can be curved, angled, and/or straight. In some embodiments, teeth 112 can include ridges, grooves, spikes, protrusions, cavities, or other suitable shapes to enable paired joins to remain paired when the building unit is in a three-dimensional hollow position 108. In some embodiments, teeth 112 can have a thickness, a depth, and a width. In some embodiments, two teeth 112 can be about 15 mm wide, about 3 mm thickness, and about 3 mm depth. In some embodiments, three teeth can be about 5 mm wide, about 3 mm thick, and about 3 mm depth. In some embodiments, teeth have various widths and/or dimensions. In some embodiments, teeth 112 can be, for example, a quarter inch wide and a quarter inch tall/deep. In some embodiments, teeth 112 can be uniform or of different widths and depths. In some embodiments, teeth 112 can be rectangular. In some embodiments, teeth 112 can be rectangular rounded. In some embodiments, teeth 112 can be waves. In some embodiments, teeth 112 can be spikes. In some embodiments, teeth 112 can be protrusions. In some embodiments, teeth 112 can be latches. In some embodiments, joins 110 can comprise one or more angle-edge teeth 112, which function as a finger pull for ease of opening. In some embodiments the teeth 112 of the join 110 are rounded on two axes for smooth interleaving and reduced friction. In some embodiments the teeth 112 of the join 110 are rounded on one axis, which creates more friction than when teeth 112 are rounded on two axes. In some embodiments, there is friction where the teeth 112 of two joins 110 come together, with the inner teeth 112 along the join edge providing more friction.

In some embodiments, the thickness of joins 110 and depth of the teeth 112 can vary for each material of the building unit 100. In some embodiments the joins 110 can be about 0.2 mm to tens mm thick, or any range or value between. In some embodiments, teeth 112 can be the same thickness as the joins 110. In some embodiments, width of teeth 112 can range from about 0.2 mm to tens mm wide, or any range or value between. In some embodiments, teeth 112 can be about 0.2 mm to tens mm deep, or any range or value between. In some embodiments, the thickness of one or more of the teeth 112 of a join 110 on one section 104 can be about the depth of one or more of the teeth 112 of another join 110 on another section. In some embodiments, the depth and thickness of the teeth can vary relative to the thickness of the material (e.g., sheeting or molded material) of the toy building unit 100, whereas the width of the teeth 112 can be a fraction of the entire length of an edge of a section. In some embodiments, the minimum and/or maximum thickness of joins 110 and/or teeth 112, depth of teeth 112, and width of teeth 112 can vary for each material. In some embodiments, the minimum and/or maximum thickness of joins and depth of teeth varies for each material of the building unit 100 such that the dimensions allow the building unit in a three-dimensional hollow position 108 to close properly and reversibly open.

In some embodiments, the building unit 100 can include one or more edges. In some embodiments, the edges can be the edges of the sections 104. In some embodiments, the edges of the sections 104 of the building unit 100 can be a join 110. In some embodiments, the edges of the section 104 are un-joined joins 110. In some embodiments, the edges of the building unit 100 are un-joined joins 110. In some embodiments, the edges can be the edges of the three-dimensional hollow building unit 114. In some embodiments, the edges of the three-dimensional hollow building unit 114 can be a hinge 106 that connects two sections 104 of the building unit. In some embodiments, the edges of the three-dimensional hollow building unit 114 can be two joins 110 that come together (e.g., interleaved, paired, clicked in place, removably attached, held together by friction, and the like) to form an edge of the three-dimensional hollow building unit 114.

In some embodiments, the closed joins 110 can create the building unit in a three-dimensional hollow position 108. In some embodiments, the closed joins 110 connect the sections 104 of the building unit 100 to each other predominantly by static friction so that the resulting polyhedron remains closed during play. In other words, in some embodiments, the building unit in a three-dimensional hollow position 108 remains closed by the static friction force in the closed joins 110 and thus there is no need for glue, tucking, magnets, or any other means. In some embodiments, the closed joins 110 may be pulled open by an intentional manual force to return the building unit 100 unit to a flat position 102. In some embodiments, the transition between the building unit 100 in a flat position 102 with open joins to the building unit in a three-dimensional hollow position 108 with closed joins 110 is reversible and repeatable. In some embodiments, the transition between the building unit 100 in a flat position 102 with open joins to the building unit in a three-dimensional hollow position 108 with closed joins is not reversible and repeatable. In some embodiments, the transition between the building unit 100 in a flat position 102 with open joins to the building unit in a three-dimensional hollow position 108 with closed joins 110 is partially reversible and repeatable such that some sections 104 feature joins 110 that can be opened and closed in a reversable and repeatable manner, while other sections 104 feature joins 110 that cannot be opened and closed in a reversable and repeatable manner.

Shapes

In some embodiments, the building unit 100 can fold from a flat position 102 into a three-dimensional hollow position 108. In some embodiments, the building unit in a flat position 102 can be described using the mathematical concept of a two-dimensional (2D) net. In some embodiments, the building unit in a flat position 102 can be described as a net, a 2D net, a net of a solid, a net of a polyhedron, a cut-out, a stencil, a paper sheet, or the like. A net is an arrangement of non-overlapping edge-joined polygons in the plane which can be folded (along edges) to become the faces of the polyhedron. Many different nets can exist for a given polyhedron, depending on the choices of which edges are joined and which are separated. Nets are known. For example, there are eleven nets of a cube, wherein each net is a unique arrangement of sections 104 of the net.

In some embodiments, the building unit 100 can be a cuboid, square based pyramid, triangle volume, domed cuboid, half cylinder, quarter cylinder, or any other three-dimensional shape (e.g., any polyhedron). In some embodiments, a three-dimensional hollow position 108 of the building unit 100 can be a cuboid, square based pyramid, triangle volume, domed cuboid, half cylinder, quarter cylinder, or any other three-dimensional shape (e.g., any polyhedron).

In some embodiments, the building unit 100 can be a cuboid. In some embodiments, the cuboid can be a cube where the ratio of width:length:height is equal. For example, in some embodiments that cuboid can be about 10 to about 1000 mm in width, length, and height. In some embodiments a cuboid can be an extended cube where one dimension of the width:length:height ratio is extended. In some embodiments, a cuboid can be a rectangular prism where one or more dimension of the width:length:height ratio is extended. In some embodiments, the cuboid unit can include five hinges 106 and fourteen joins 110. In some embodiments, the building unit 100 of the cuboid unit can include six sections 104. In some embodiments, the fourteen joins 110, when closed, form eight edges of the cuboid (e.g., edge of the three-dimensional hollow building unit 114) and the five hinges 106 form five edges of the cuboid (e.g., edge of the three-dimensional hollow building unit 114). In some embodiments, the width of the cuboid can be about 10 mm to about 1000 mm. In some embodiments, the length of the cuboid can be about 10 mm to about 1000 mm. In some embodiments, the height of the cuboid can be about 10 mm to about 1000 mm.

In some embodiments, the building unit 100 can be a square based pyramid. In some embodiments, the square based pyramid can include four hinges 106 and eight joins 110. In some embodiments, the building unit 100 of the square based pyramid can include five sections 104. In some embodiments, the eight joins 110, when closed, form four edges of the square based pyramid (e.g., edge of the three-dimensional hollow building unit 114), and the four hinges 106 form four edges of the square based pyramid (e.g., edge of the three-dimensional hollow building unit 114). In some embodiments, the base of the square based pyramid can be about 10 mm to about 1000 mm by about 10 to about 1000 mm. In some embodiments, the height of the square based pyramid can be about 10 mm to about 1000 mm at the tallest point.

In some embodiments, the building unit 100 can be a triangle volume. In some embodiments, the triangle volume can include four hinges 106 and ten joins 110. In some embodiments, the building unit 100 of the triangle volume can include five sections 104. In some embodiments, the ten joins 110, when closed, form five edges of the triangle volume (e.g., edge of the three-dimensional hollow building unit 114), and the four hinges 106 form four edges of the triangle volume (e.g., edge of the three-dimensional hollow building unit 114). In some embodiments, the width of the triangle volume can be about 10 mm to about 1000 mm. In some embodiments, the length of the triangle volume can be about 10 mm to about 1000 mm. In some embodiments, the height of the triangle volume can be about 10 mm to about 1200 mm at the tallest point.

In some embodiments, the building unit in a three-dimensional hollow position 108 can include a volume with a cylindrically curved surface, with one section that curves into a three-dimensional position by flexing the material of the building unit 100 to connect to an adjoining section 104 on which the join 110 is curved. The flexibility of the curved section 104 can be enabled by the use of a flexible material to make the building unit 100, or by adding features such as ribbing or cuts into a rigid material.

In some embodiments, the building unit 100 can be a domed cuboid. In some embodiments, the domed cuboid can include five hinges 106 and fourteen joins 110. In some embodiments, the building unit 100 of the domed cuboid can include six sections 104. In some embodiments, the fourteen joins 110, when closed, form seven edges of the domed cuboid (e.g., edge of the three-dimensional hollow building unit 114), and the five hinges 106 form five edges of the domed cuboid (e.g., edge of the three-dimensional hollow building unit 114). In some embodiments, the width of the domed cuboid can be about 10 mm to about 1000 mm. In some embodiments, the length of the domed cuboid can be about 10 mm to about 1000 mm. In some embodiments, the height of the domed cuboid can be about 10 mm to about 1200 mm at the tallest point.

In some embodiments, the building unit 100 can be a half cylinder. In some embodiments, the half cylinder can include three hinges 106 and six joins 110. In some embodiments, the building unit 100 of the half cylinder can include four sections 104. In some embodiments, the six joins 110, when closed, form three edges of the half cylinder (e.g., edge of the three-dimensional hollow building unit 114), and the three hinges 106 form three edges of the half cylinder (e.g., edge of the three-dimensional hollow building unit 114). In some embodiments, the width of the half cylinder can be about 10 mm to about 1000 mm. In some embodiments, the length of the half cylinder can be about 10 mm to about 1000 mm. In some embodiments, the height of the half cylinder can be about 10 mm to about 1200 mm at the tallest point.

In some embodiments, the building unit 100 can be a quarter cylinder. In some embodiments, the quarter cylinder can include four hinges 106 and ten joins 110. In some embodiments, the building unit 100 of the quarter cylinder can include five sections 104. In some embodiments, the ten joins 110, when closed, form five edges of the quarter cylinder (e.g., edge of the three-dimensional hollow building unit 114), and the four hinges 106 form four edges of the quarter cylinder (e.g., edge of the three-dimensional hollow building unit 114). In some embodiments, the width of the quarter cylinder can be about 10 mm to about 1000 mm. In some embodiments, the length of the quarter cylinder can be about 10 mm to about 1000 mm. In some embodiments, the height of the quarter cylinder can be about 10 mm to about 1000 mm.

In some embodiments, any shape or configuration could be used.

Materials

In some embodiments, the toy building unit 100 can be made of a material suitable for method of manufacturing a toy building unit 100 that is capable of folding from a flat position 102 into a three-dimensional hollow position 108 wherein the building unit 100 can include a plurality of sections 104, wherein the plurality of sections 104 can be delineated from and connected to at least one other section 104 with a hinge 106 that is integral to the building unit, a plurality of joins 110 (which are the outer edges of the building unit) outlining the building unit 100, wherein the joins 110 can connect the sections 104 of the building unit 100 forming edges of the closed three-dimensional hollow building unit 108.

In some embodiments, the building unit 100 can be made of a material. In some embodiments, the material can be cardstock, cardboard, bagasse, wood, wood sheeting, particle board, laminate, plastic, plastic sheeting, vellum, vellum paper, rubber, foam sheeting, vinyl sheeting, rubber sheeting, plasticized pulp, pulp, recycled pulp, or any combination thereof. In some embodiments, a pulp can be, for example, paper pulp, bagasse pulp, hemp pulp, bamboo pulp, wood pulp, or any combination thereof. In some embodiments, the building unit 100 can be made of a material that further includes a resin. In some embodiments, a resin can be, for example, polyester resin, phenolic resin, alkyd resin, polycarbonate resin, polyamide resin, polyurethane resin, silicone resin, epoxy resin, UV resin, or combinations thereof. In some embodiments, the building unit 100 can be made of a material that includes coatings. In some embodiments, coatings can include wax, plastic, bioplastic, or combinations thereof. In some embodiments, the building material 100 can be made of a material that includes one or more additives. In some embodiments, the building unit 100 can include a laminate of one or more material. In some embodiments, a laminate can be two or more layers of different materials, often with a plastic being the outer layer, e.g., laminated paper can be a plastic layer bonded to a paper layer, and laminated wood is generally a plastic layer bonded to a wood layer (could be three layers chip board, wood veneer, then plastic). In some embodiments, one or more additives can include resin, coatings, colorants, stabilizers, a laminate, and the like.

Manufacturing

Provided herein in some embodiments are methods of manufacturing the toy building unit 100 disclosed herein.

In some embodiments, the toy building unit 100 can be manufactured from a single sheet of material. In some embodiments, the method can include cutting a building unit 100 from a single sheeting material; forming a plurality of hinges 106; and forming from the edge of a segment of the building unit, a plurality of joins. In some embodiments, the cutting process can be die cutting, laser-cutting, or combinations thereof (see e.g., https://www.iqsdirectory.com/articles/die-cutting.html#capabilities-of-a-die-cutting-machine; https://en.wikipedia.org/wiki/Die_cutting_(web); and https://en.wikipedia.org/wiki/Laser_cutting). In some embodiments, the hinges 106 can be formed by crease scoring the material (see e.g., https://www.iqsdirectory.com/articles/die-cutting.html#capabilities-of-a-die-cutting-machine). In some embodiments, the hinges 106 can be formed by cut scoring the material (see e.g., https://www.iqsdirectory.com/articles/die-cutting.html#capabilities-of-a-die-cutting-machine). In some embodiments, the building unit 100 manufactured by die cutting, laser-cutting, crease scoring, cut scoring, and combinations thereof can be made of cardstock, plastic sheeting, wood sheeting, bagasse sheeting, foam sheeting, particle board, vellum paper, cardboard, paper, vinyl sheeting, rubber sheeting and laminates of any of these materials. In some embodiments, the method can include cutting a plurality of teeth 112 from the edge of a section 104 of the building unit 100. In some embodiments, the method can include a straight edge. In some embodiments, the straight edge can crease score or cut score the building unit 100 to form the hinges 106. In some embodiments, the method can be digital.

In some embodiments, the method of manufacturing a toy building unit 100 can include forming, by a molding process of a material, a building unit that can include a plurality of sections 104, wherein the plurality of sections 104 can be delineated from and connected to at least one other section with a hinge that is integral to the building unit 100; and a plurality of joins 110 along the outer edges of the building unit 100. In some embodiments, the joins 110 can comprise one or more, or a plurality of teeth 112. In some embodiments, the molding process of the material can include injection molding (see e.g., https://en.wikipedia.org/wiki/Injection moulding). Suitable materials for injection molding can include plastic, bioplastic, rubber, or combinations thereof.

In some embodiments, the molding process of material can include wet pressing, dry pressing, transfer molding, thermoforming, or combinations thereof (see e.g., https://en.wikipedia.org/wiki/Molded_pulp; https://www.goldenarrow.com/blog/what-molded-fiber-pulp; Moulded Pulp Manufacturing: Overview and Prospects for the Process Technology Article in Packaging Technology and Science February 2017. https://www.researchgate.net/publication/314131029_Moulded_Pulp_Manufacturing_Ov erviewand_Prospects_for_the_Process_Technology). Suitable materials for wet pressing, dry pressing, transfer molding, thermoforming, or combinations thereof can include paper pulp, bagasse pulp, hemp pulp, bamboo pulp, wood pulp, recycled pulp, or combinations thereof. Suitable materials for wet pressing, dry pressing, transfer molding, thermoforming, or combinations thereof can further include resins, wax, plastic, bioplastic, or combinations thereof.

In some embodiments the method can include a waterproofing step.

In some embodiments the method can be three-dimensional printing.

EXAMPLES

The figures provided herein illustrate the toy building unit 100 and features thereof according to some embodiments of the present disclosure. The figures show combination with hinges 106 and joins 110, but any combination of joins 110 and hinges 106 can be used. For example, in some non-limiting embodiments, the building unit 100 can include only joins 110 between sections 104.

Figure 1B:
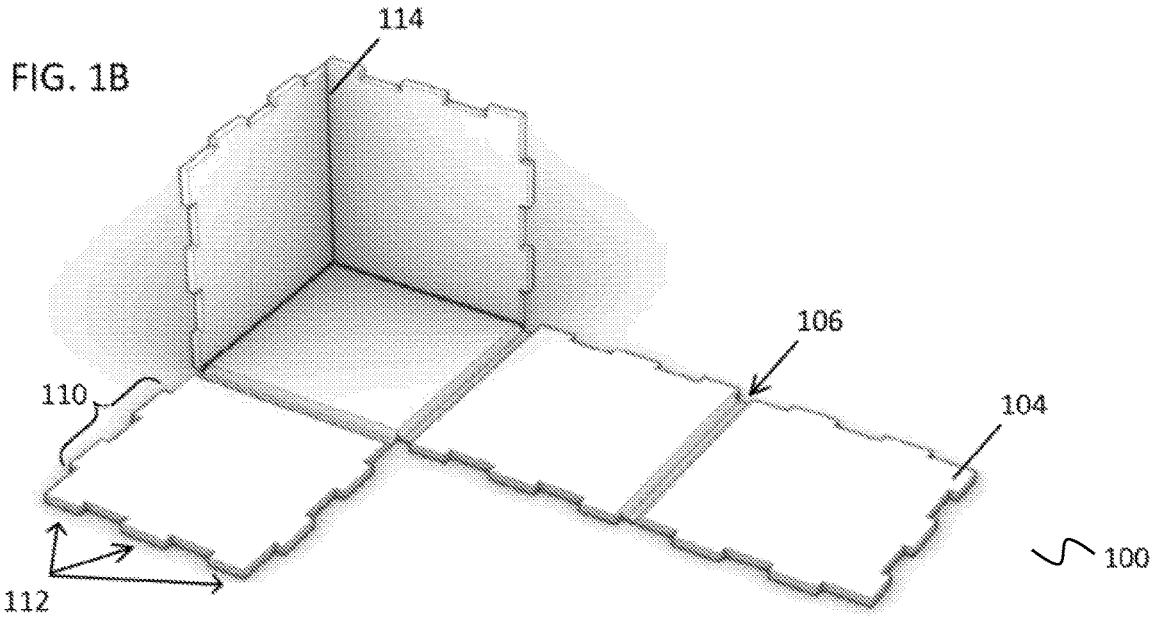
FIG. 1B illustrates a toy building unit partially folded into a three-dimensional hollow unit, according to some aspects of the disclosure.
Figure 1C:
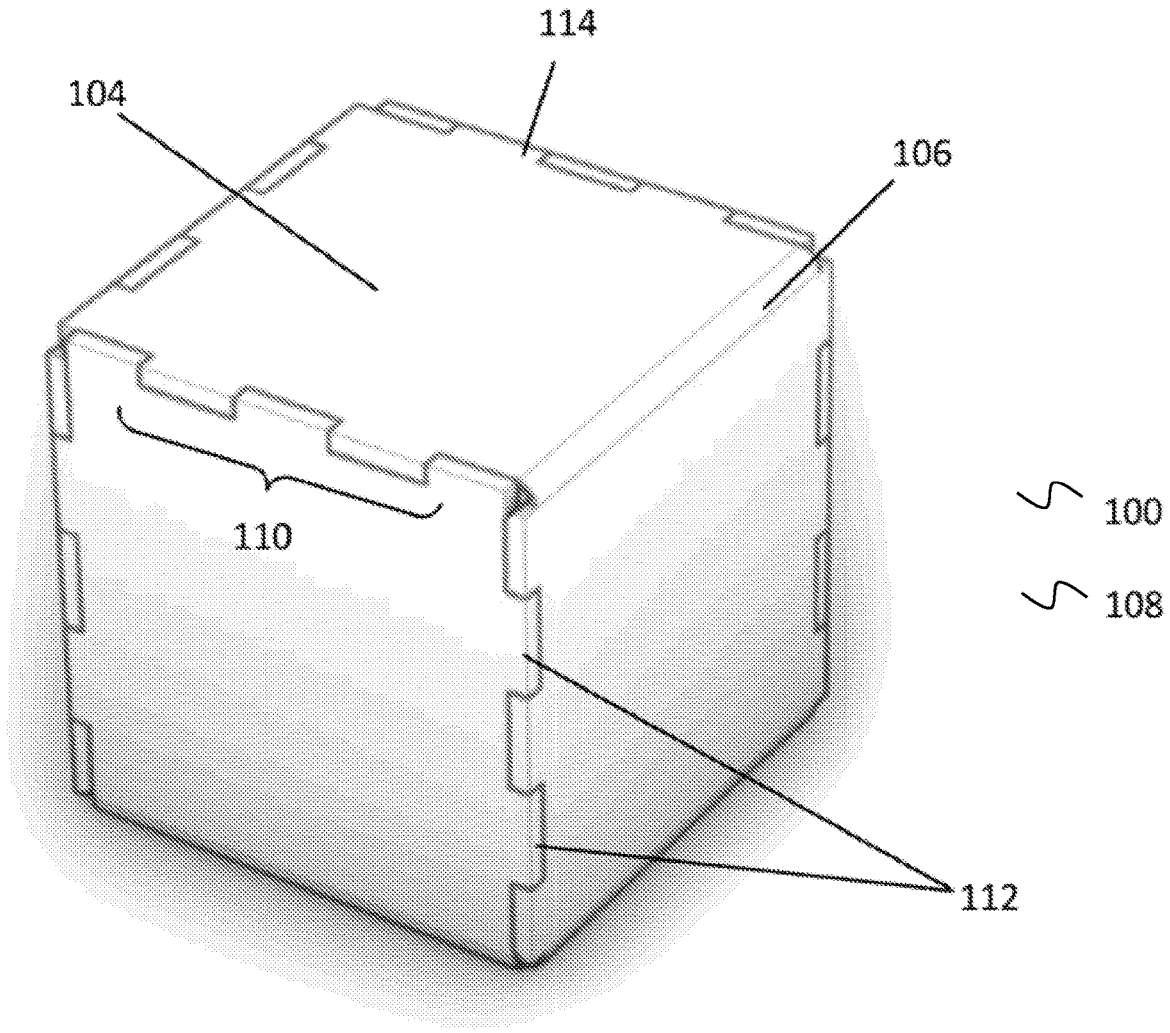
FIG. 1C illustrates a toy building unit in a closed position, according to some aspects of the disclosure.

FIG. 1 illustrates a cuboid toy building unit 100 in the flat position 102, partially constructed position, in the three-dimensional hollow building unit 108, according to some embodiments of the present disclosure. FIG. 1A illustrates a toy building unit in a flat position 102, according to some aspects of the disclosure. In some embodiments, the toy building unit 100 can include five hinges 106, as illustrated in FIG. 1. In some embodiments, the toy building unit 100 can include no hinges 106. In some embodiments the toy building unit 100 can include a plurality of hinges 106. In some embodiments, the toy building unit 100 can include six sections 104 as shown in FIG. 1. In some embodiments, the toy building unit 100 can include a plurality of sections 104. In some embodiments, the toy building unit 100 can include fourteen joins 110 as shown in FIG. 1. In some embodiments, the joins can outline the sections 104 of the building unit in a flat position 102. In some embodiments, the toy building unit 100 can include a plurality of joins 110. In some embodiments, the join 110 can include teeth 112 as shown in FIG. 1. FIG. 1B illustrates a toy building unit 100 partially folded into a three-dimensional hollow unit, according to some aspects of the disclosure. In some embodiments, joins 110 of the building unit 100 can come together (e.g., interleave) and form an edge of the three-dimensional hollow building unit 114 as shown in FIG. 1B-C. FIG. 1C illustrates a toy building unit in a closed position, according to some aspects of the disclosure.

Figure 2A:
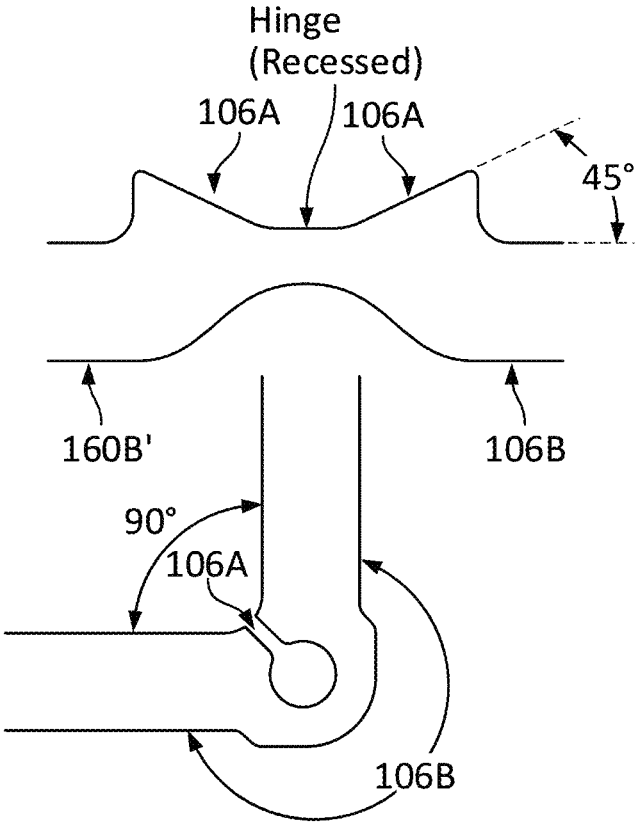
FIG. 2A illustrates hinge of toy building unit, according to some aspects of the disclosure.
Figure 2B:
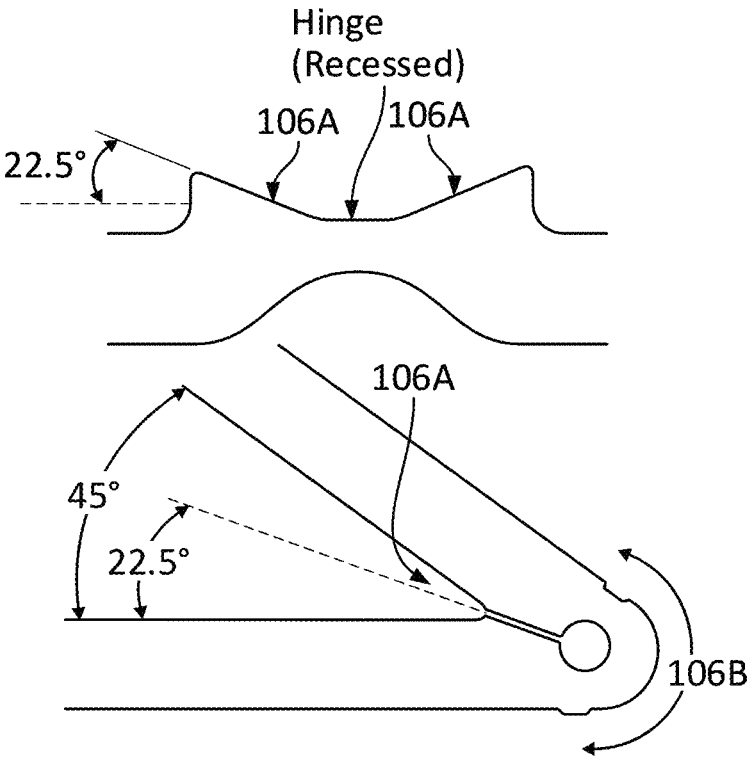
FIG. 2B illustrates hinge of toy building unit, according to some aspects of the disclosure.

FIG. 2 illustrates hinge 106 of the toy building unit 100. In some embodiments, the hinge 106 can be recessed such that a 45° angle can be formed when the building unit is in a flat position 102 as shown in FIG. 2A. In some embodiments, the hinge 106 can form a 90° angle when the building unit 100 is in a partially constructed position or in a three-dimensional hollow position 108 as shown in FIG. 2A. In some embodiments, the hinge 106 can be recessed such that a 22.5° angle can be formed when the building unit is in a flat position 102 as shown in FIG. 2B. In some embodiments, the hinge 106 can form a 45° angle when the building unit 100 is in a partially constructed position or in a three-dimensional hollow position 108 as shown in FIG. 2B. In some embodiments, the hinge 106 can form an angle that can be about a 15° angle up to a 150° angle or any range or value between when the building unit 100 is partially constructed position or in a three-dimensional hollow position 108.

Figure 3A:
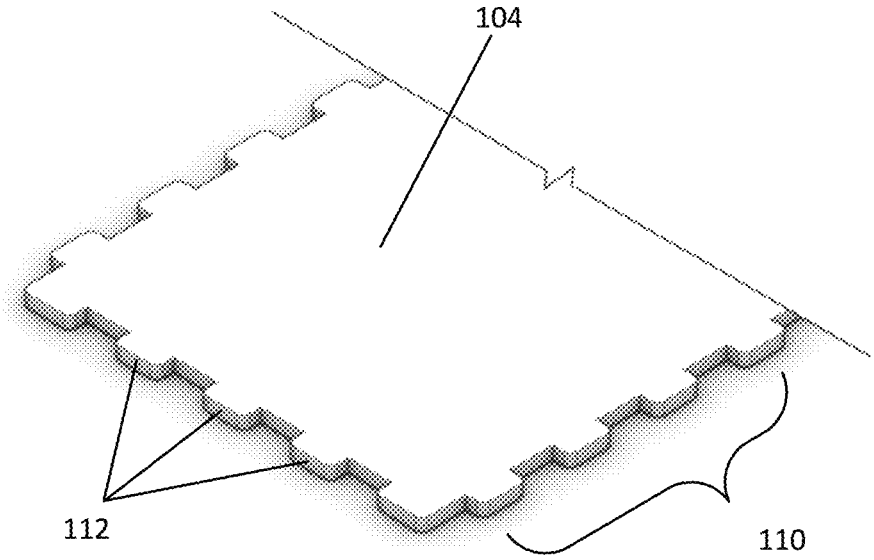
FIG. 3A illustrates joins of a toy building unit, according to some aspects of the disclosure.
Figure 3B:
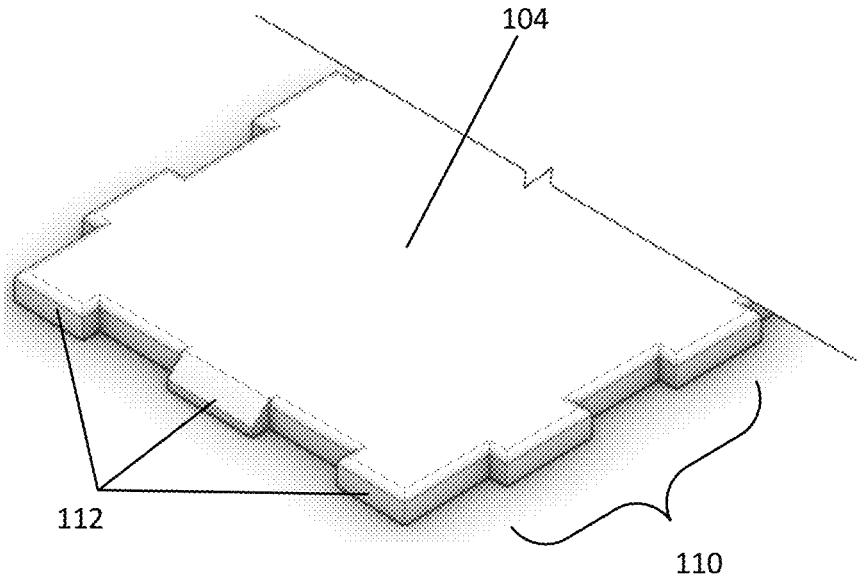
FIG. 3B illustrates joins of a toy building unit, according to some aspects of the disclosure.

FIG. 3 illustrates various join 110 designs on the toy building unit 100 according to some embodiments. FIG. 3A illustrates a close-up view of die-cut join teeth with 1.5 mm thick side walls which may be implemented in plastic sheeting, cardstock, wood, laminate, for example. In some embodiments, the toy building unit 100 can include one or more sections 104 with one or more joins 110, which can include one or more teeth 112 as shown in FIG. 3A. In some embodiments, the join 110 can have four or five teeth 112 as shown in FIG. 3A. In some embodiments, the teeth 112 can be cut perpendicular to the surface 104 as shown in FIG. 3A. FIG. 3B illustrates a close-up view of an injection molded implementations with teeth 112 of lower granularity, 3 mm thick side walls which may be implemented in molded plastic, molded bagasse pulp, molded rubber, for example. FIG. 3A also illustrates an angled-edge teeth 112 design that functions as a finger pull for ease of opening, according to some embodiments. FIG. 3B illustrates rounded edges along two directions of the teeth 112 to enable smooth interleaving and reduce friction. In some embodiments, rounded edges can be along one edge of the teeth 112 (not shown) to decrease friction over the embodiment depicted in FIG. 3B. In some embodiments, the toy building unit 100 can include one or more sections 104 with one or more joins 110, which can include one or more teeth 112 as shown in FIG. 3B. In some embodiments, the join 110 can have two or three teeth 112 as shown in FIG. 3B. In some embodiments, the teeth 112 can be molded as shown in FIG. 3B.

Figure 3C:
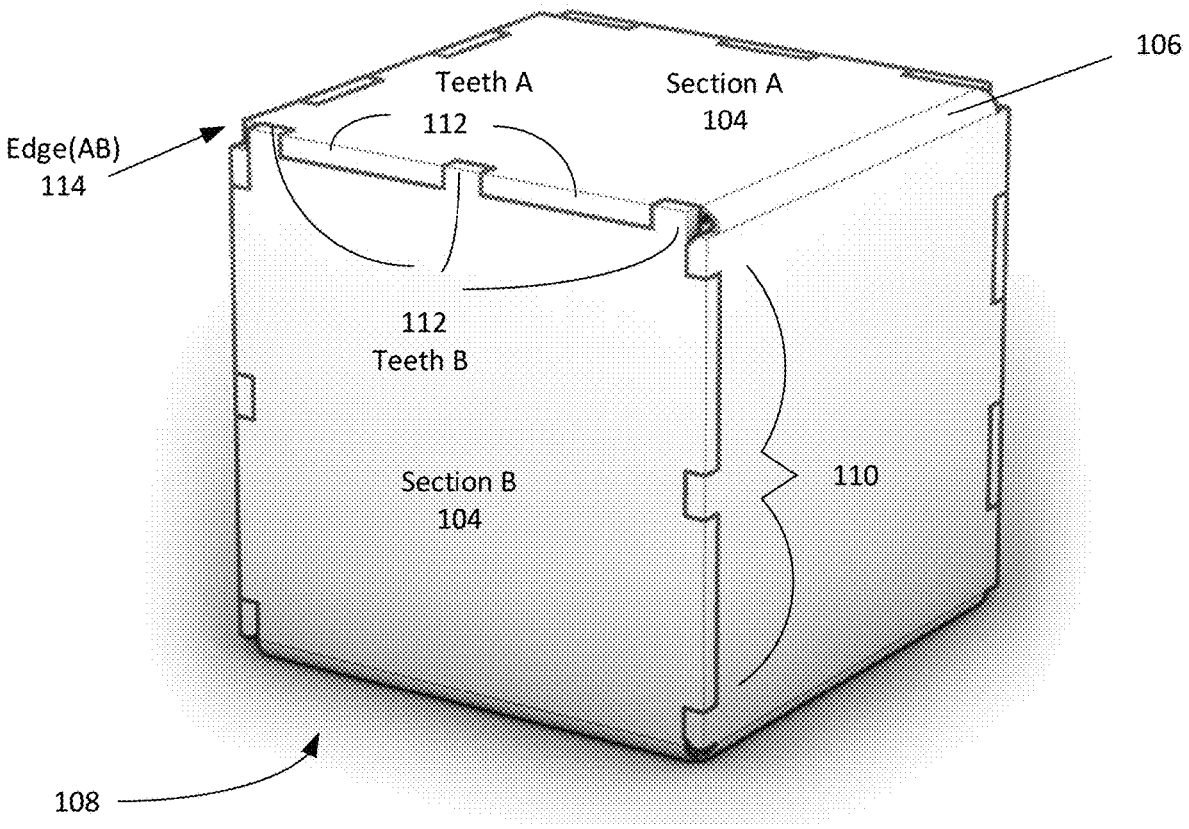
FIG. 3C illustrates joins of a toy building unit connecting to form a three-dimensional hollow unit, according to some aspects of the disclosure.

FIG. 3C illustrates joins 112 of a toy building unit connecting to form a three-dimensional hollow unit 108, according to some aspects of the disclosure. FIG. 3C shows a view of the building unit in three-dimensional hollow position 108, the building unit 100 has one or more hinges 106, one or more sections 104, one or more joins 110, one or more teeth 112, and one or more edges of the three-dimensional hollow building unit 114. In some embodiments, two or more sections 104 of the building unit 100 can connect. In some embodiments, the edge of the three-dimensional hollow building unit 114 can be connected by joins as shown by Edge(AB) 114 in FIG. 3C. In some embodiments, the edge of the three-dimensional hollow building unit 108 can be a hinge 106 between two sections 104. In some embodiments, Edge(AB) 114 can connect two sections 104. One section can be, for example, Section A 104 and another section can be, for example, Section B 104, as shown in FIG. 3C. In some embodiments, Edge(AB) 114 can connect Section A 104 and Section B 104, as shown in FIG. 3C. In some embodiments, an edge of the three-dimensional hollow building unit 114 can be formed by the pairing of two joins 110. In some embodiments, the edge of the three-dimensional hollow building unit 114 can be Edge(AB). In some embodiments, the two joins 110 can be Join A 110 and Join B 110, as shown in FIG. 3C. In some embodiments, Edge(AB) 114 can be formed by the pairing of Join A 110 and Join B 110, as shown in FIG. 3C. In some embodiments, the width of the teeth 112 of one join 110 can be longer than the width of the teeth 112 of another join 110. In some embodiments, the thickness of the teeth 112 of one join 110 can be equal and/or about equal to the depth of the teeth 112 of another join 110. In some embodiments, the width of the teeth 112 in Join A 110 can be longer than the width of the teeth in Join B 110, and the thickness of the teeth 112 in Join A can be equal and/or about equal to the depth of the teeth 112 in Join B 110, as shown in FIG. 3C. In some embodiments, two teeth 112 on section A 104 can be about 15 mm wide, about 3 mm thickness, and about 3 mm depth. In some embodiments, three teeth 112 on section B 104 can be about 5 mm wide, about 3 mm thick, and about 3 mm depth. In some embodiments, teeth have various widths and/or dimensions.

Figure 4A:
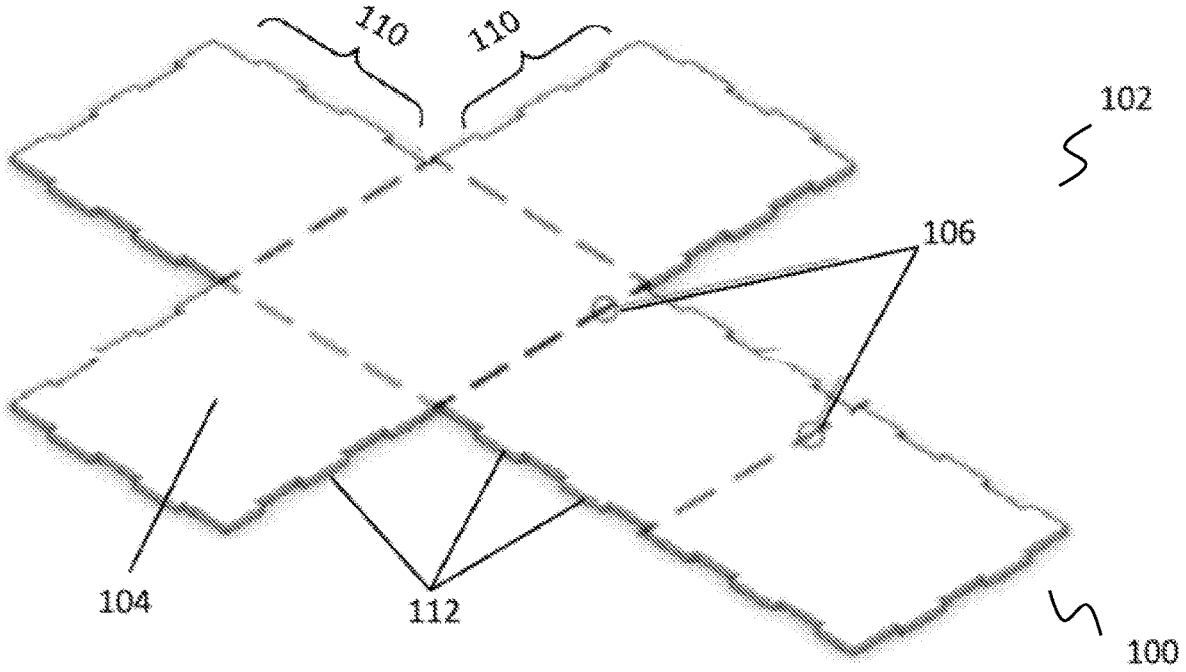
FIG. 4A illustrates a toy building unit that is a cuboid in a flat position, according to some aspects of the disclosure.
Figure 4B:
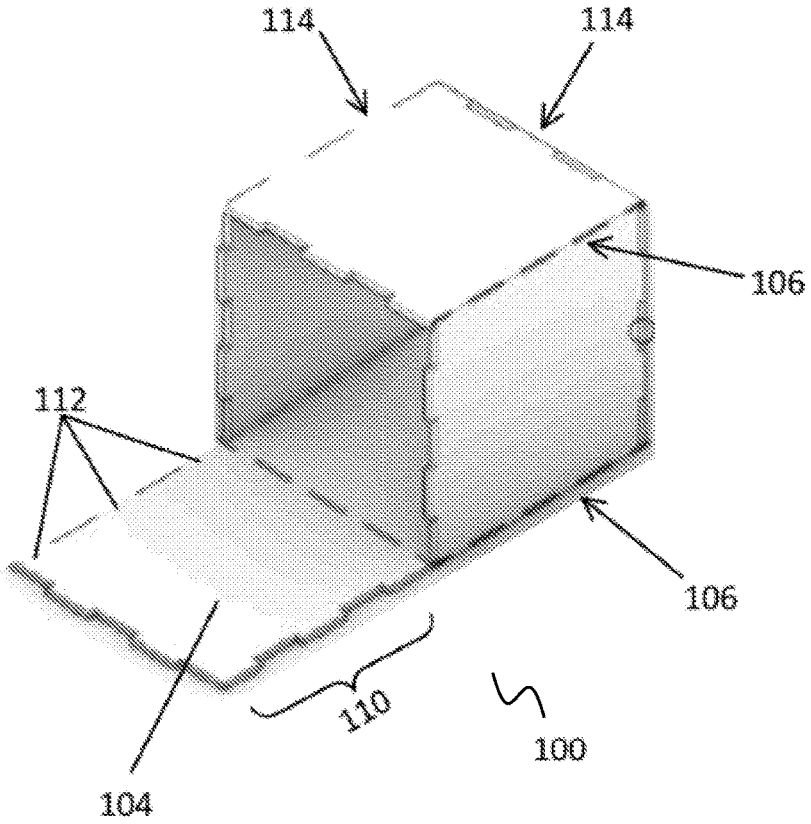
FIG. 4B illustrates a toy building unit that is partially constructed as a cuboid in a three-dimensional hollow unit, according to some aspects of the disclosure.

FIG. 4 illustrates a cuboid toy building unit 100 in the flat position 102 and in a partially constructed position, according to some embodiments of the present disclosure. FIG. 4A illustrates a toy building unit in a flat position 102, according to some aspects of the disclosure. In some embodiments, the toy building unit 100 can include five hinges 106, as illustrated in dotted lines in FIG. 4. In some embodiments, the toy building unit 100 can include no hinges 106. In some embodiments the toy building unit 100 can include a plurality of hinges 106. In some embodiments, the toy building unit 100 can include six sections 104 as shown in FIG. 4. In some embodiments, the toy building unit 100 can include a plurality of sections 104. In some embodiments, the toy building unit 100 can include fourteen joins 110 as shown in FIG. 4. In some embodiments, the joins can outline the sections 104 of the building unit in a flat position 102. In some embodiments, the toy building unit 100 can include a plurality of joins 110. In some embodiments, the join 110 can include teeth 112 as shown in FIG. 4. FIG. 4B illustrates a toy building unit 100 partially folded into a three-dimensional hollow unit, according to some aspects of the disclosure. In some embodiments, joins 110 of the building unit 100 can come together (e.g., interleave) and form an edge of the three-dimensional hollow building unit 114 as shown in FIG. 4B.

Figure 5A:
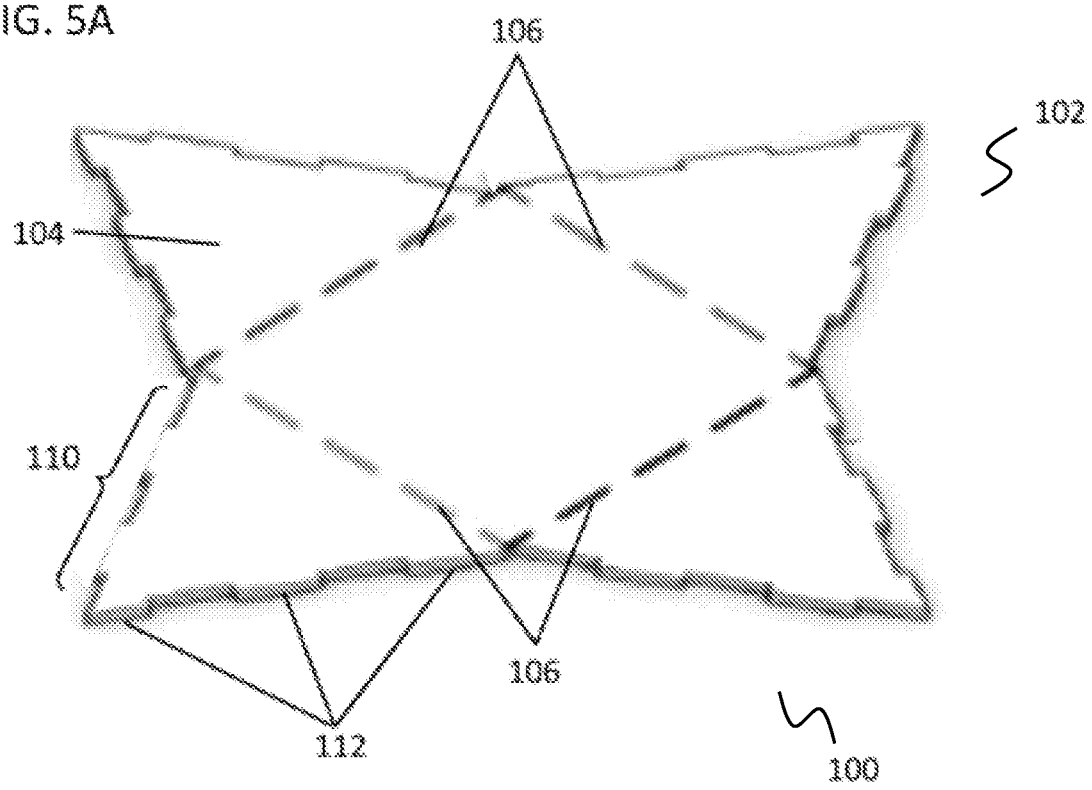
FIG. 5A illustrates a toy building unit that is a square based pyramid in a flat position, according to some aspects of the disclosure.
Figure 5B:
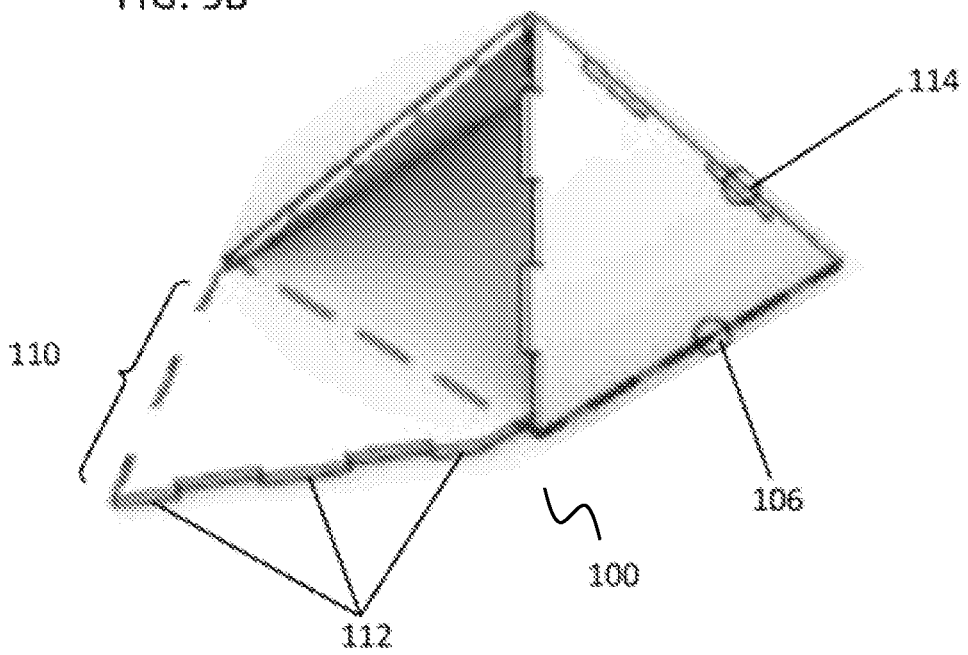
FIG. 5B illustrates a toy building unit that is partially constructed as a square based pyramid in a three-dimensional hollow unit, according to some aspects of the disclosure.

FIG. 5 illustrates a square based pyramid building unit 100 in the flat position 102 and in a partially constructed position, according to some embodiments of the present disclosure. FIG. 5A illustrates a toy building unit in a flat position 102, according to some aspects of the disclosure. In some embodiments, the toy building unit 100 can include four hinges 106, as illustrated by dotted lines in FIG. 5. In some embodiments, the toy building unit 100 can include no hinges 106. In some embodiments the toy building unit 100 can include a plurality of hinges 106. In some embodiments, the toy building unit 100 can include five sections 104 as shown in FIG. 5. In some embodiments, the toy building unit 100 can include a plurality of sections 104. In some embodiments, the toy building unit 100 can include eight joins 110 as shown in FIG. 5A. In some embodiments, the joins can outline the sections 104 of the building unit in a flat position 102. In some embodiments, the toy building unit 100 can include a plurality of joins 110. In some embodiments, the join 110 can include teeth 112 as shown in FIG. 5. FIG. 5B illustrates a toy building unit 100 partially folded into a three-dimensional hollow unit, according to some aspects of the disclosure. In some embodiments, joins 110 of the building unit 100 can come together (e.g., interleave) and form an edge of the three-dimensional hollow building unit 114 as shown in FIG. 5B.

Figure 6A:
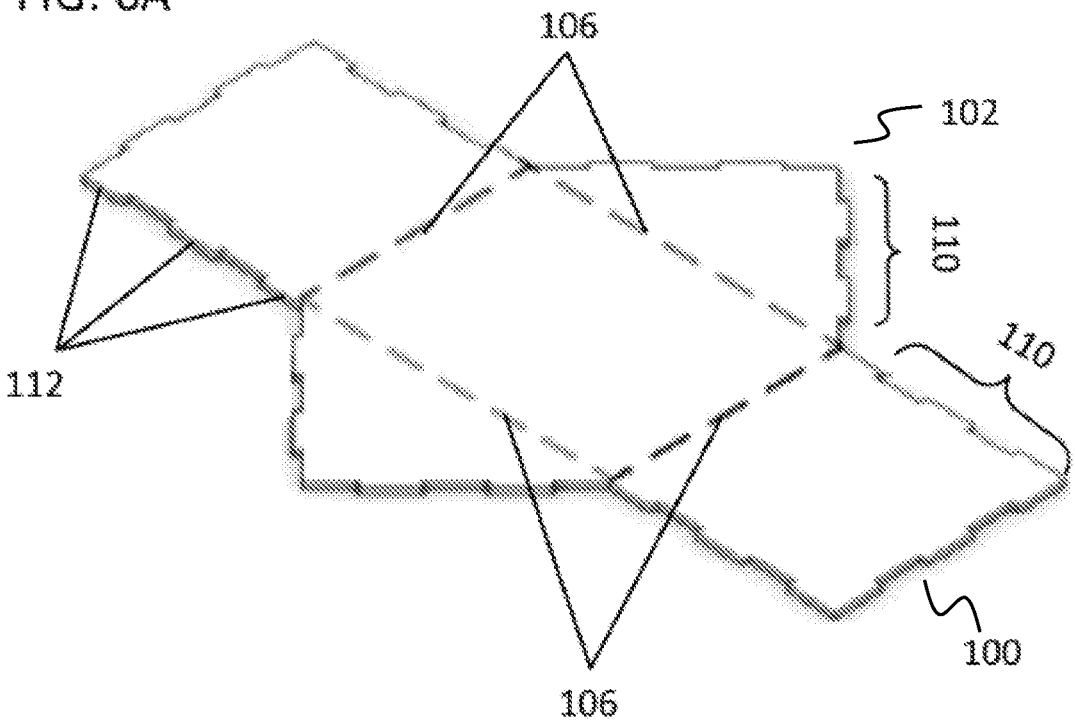
FIG. 6A illustrates a toy building unit that is a triangle volume in a flat position, according to some aspects of the disclosure.
Figure 6B:
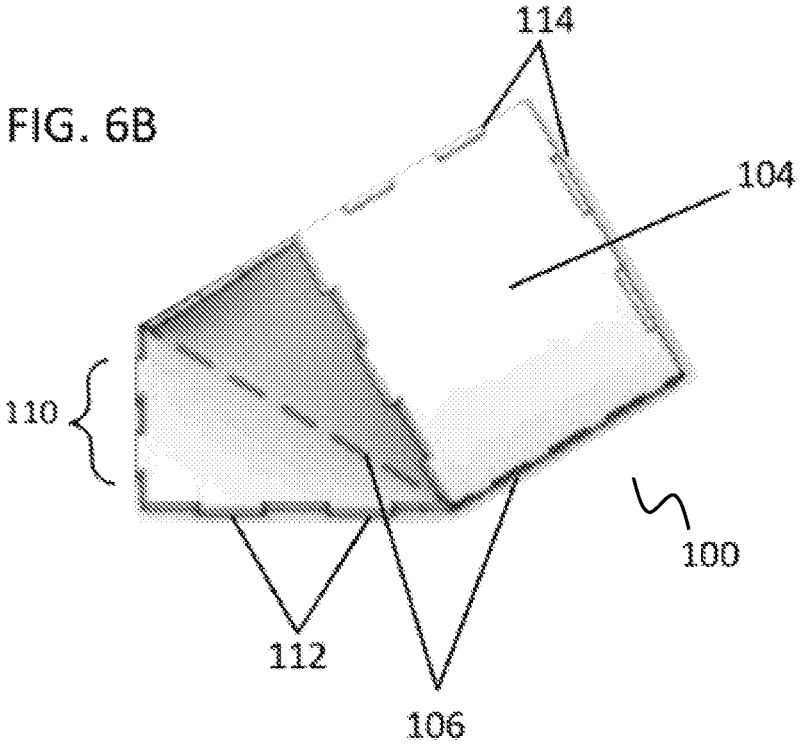
FIG. 6B illustrates a toy building unit that is partially constructed as a triangle volume in a three-dimensional hollow unit, according to some aspects of the disclosure.

FIG. 6 illustrates a triangle volume building unit 100 in the flat position 102 and in a partially constructed position, according to some embodiments of the present disclosure. FIG. 6A illustrates a toy building unit in a flat position 102, according to some aspects of the disclosure. In some embodiments, the toy building unit 100 can include four hinges 106, as illustrated by dotted lines in FIG. 6. In some embodiments, the toy building unit 100 can include no hinges 106. In some embodiments the toy building unit 100 can include a plurality of hinges 106. In some embodiments, the toy building unit 100 can include five sections 104 as shown in FIG. 6A. In some embodiments, the toy building unit 100 can include a plurality of sections 104. In some embodiments, the toy building unit 100 can include ten joins 110 as shown in FIG. 6A. In some embodiments, the joins can outline the sections 104 of the building unit in a flat position 102. In some embodiments, the toy building unit 100 can include a plurality of joins 110. In some embodiments, the join 110 can include teeth 112 as shown in FIG. 6. FIG. 6B illustrates a toy building unit 100 partially folded into a three-dimensional hollow unit, according to some aspects of the disclosure. In some embodiments, joins 110 of the building unit 100 can come together (e.g., interleave) and form an edge of the three-dimensional hollow building unit 114 as shown in FIG. 6B.

Figure 7A:
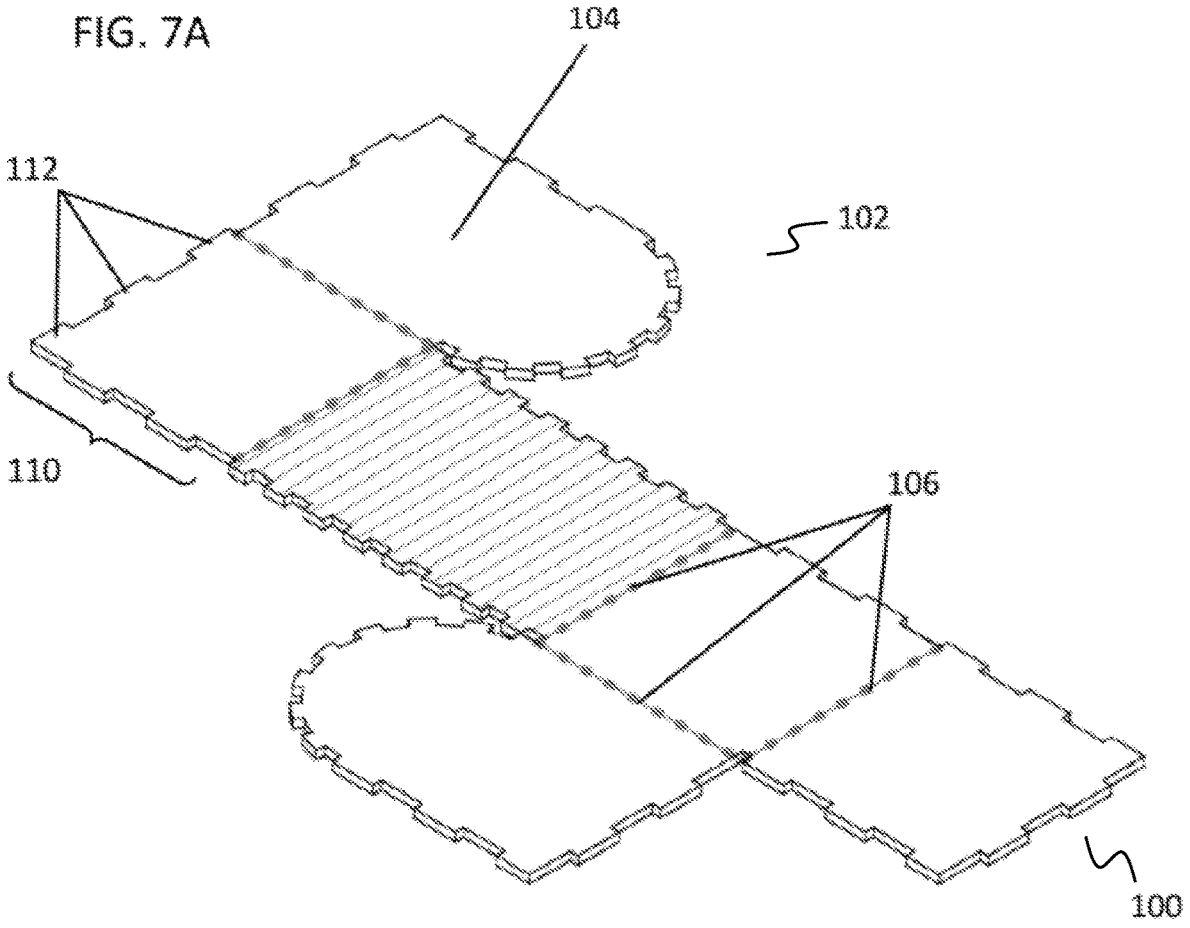
FIG. 7A illustrates a toy building unit that is a domed cuboid in a flat position, according to some aspects of the disclosure.
Figure 7B:
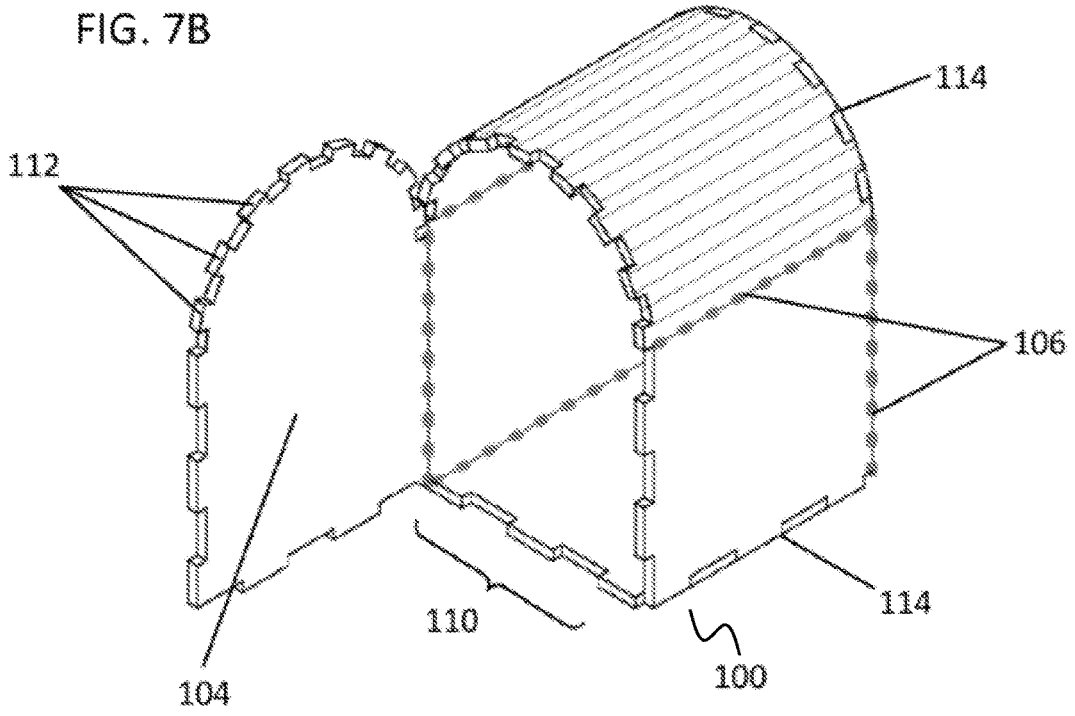
FIG. 7B illustrates a toy building unit that is partially constructed as a domed cuboid in a three-dimensional hollow unit, according to some aspects of the disclosure.

FIG. 7 illustrates a domed cuboid building unit 100 in the flat position 102 and in a partially constructed position, according to some embodiments of the present disclosure. FIG. 7A illustrates a toy building unit in a flat position 102, according to some aspects of the disclosure. In some embodiments, the toy building unit 100 can include five hinges 106, as illustrated by dotted lines in FIG. 7A. In some embodiments, the toy building unit 100 can include no hinges 106. In some embodiments the toy building unit 100 can include a plurality of hinges 106. In some embodiments, the toy building unit 100 can include six sections 104 as shown in FIG. 7A. In some embodiments, the toy building unit 100 can include a plurality of sections 104. In some embodiments, the toy building unit 100 can include fourteen joins 110 as shown in FIG. 7A. In some embodiments, the joins can outline the sections 104 of the building unit in a flat position 102. In some embodiments, the toy building unit 100 can include a plurality of joins 110. In some embodiments, the join 110 can include teeth 112 as shown in FIG. 7. FIG. 7B illustrates a toy building unit 100 partially folded into a three-dimensional hollow unit, according to some aspects of the disclosure. In some embodiments, joins 110 of the building unit 100 can come together (e.g., interleave) and form an edge of the three-dimensional hollow building unit 114 as shown in FIG. 7B.

Figure 8A:
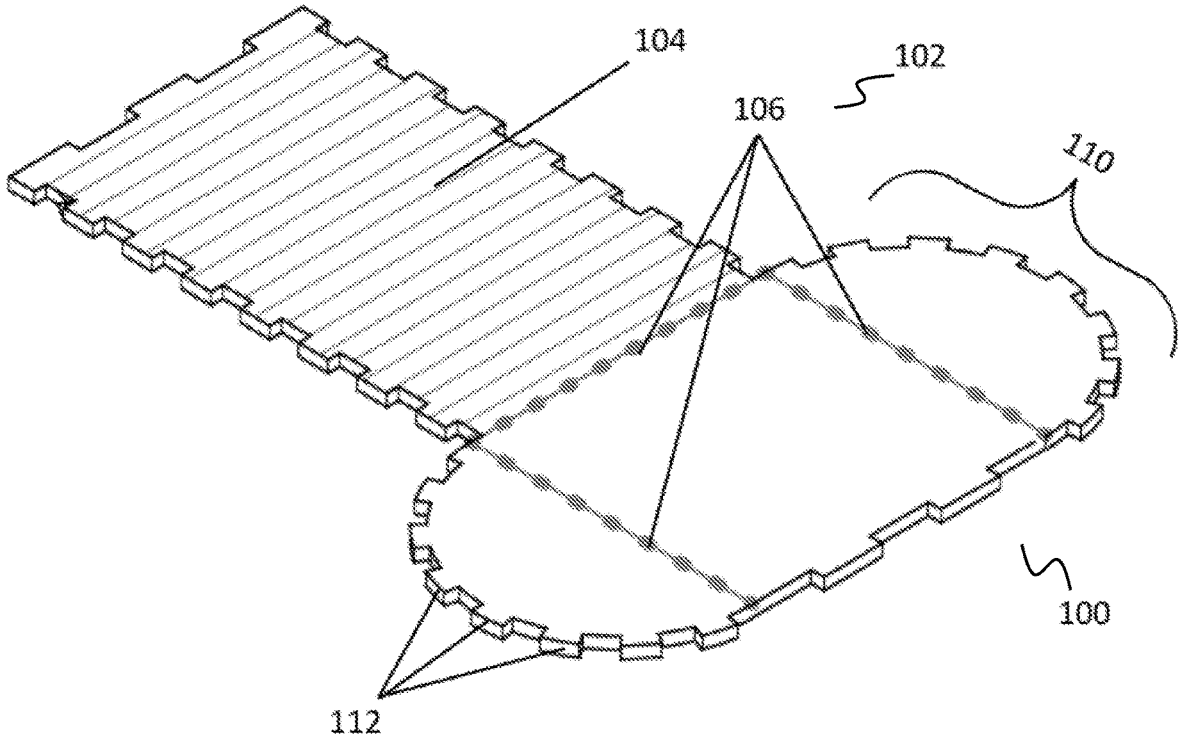
FIG. 8A illustrates a toy building unit that is a half cylinder in a flat position, according to some aspects of the disclosure.
Figure 8B:
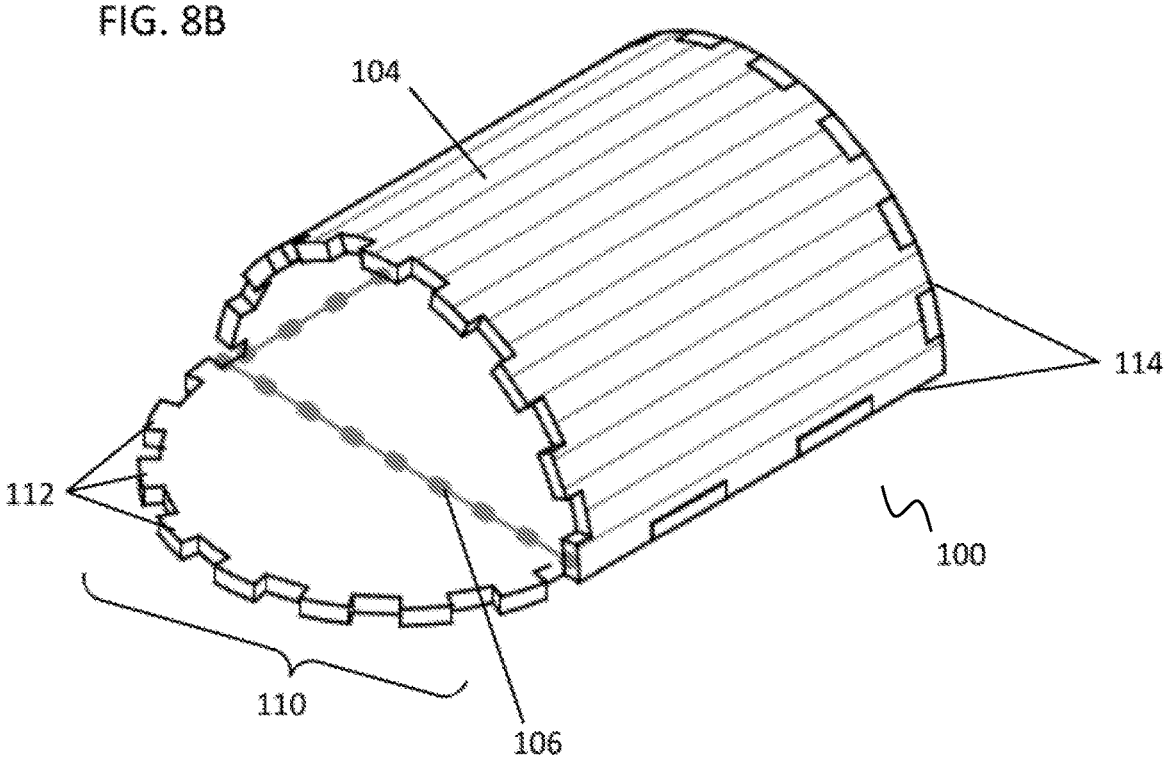
FIG. 8B illustrates a toy building unit that is partially constructed as a half cylinder in a three-dimensional hollow unit, according to some aspects of the disclosure.

FIG. 8 illustrates a half cylinder building unit 100 in the flat position 102 and in a partially constructed position, according to some embodiments of the present disclosure. FIG. 8A illustrates a toy building unit in a flat position 102, according to some aspects of the disclosure. In some embodiments, the toy building unit 100 can include three hinges 106, as illustrated by dotted lines in FIG. 8A. In some embodiments, the toy building unit 100 can include no hinges 106. In some embodiments the toy building unit 100 can include a plurality of hinges 106. In some embodiments, the toy building unit 100 can include four sections 104 as shown in FIG. 8A. In some embodiments, the toy building unit 100 can include a plurality of sections 104. In some embodiments, the toy building unit 100 can include six joins 110 as shown in FIG. 8A. In some embodiments, the joins can outline the sections 104 of the building unit in a flat position 102. In some embodiments, the toy building unit 100 can include a plurality of joins 110. In some embodiments, the join 110 can include teeth 112 as shown in FIG. 8. FIG. 8B illustrates a toy building unit 100 partially folded into a three-dimensional hollow unit, according to some aspects of the disclosure. In some embodiments, joins 110 of the building unit 100 can come together (e.g., interleave) and form an edge of the three-dimensional hollow building unit 114 as shown in FIG. 8B.

Figure 9A:
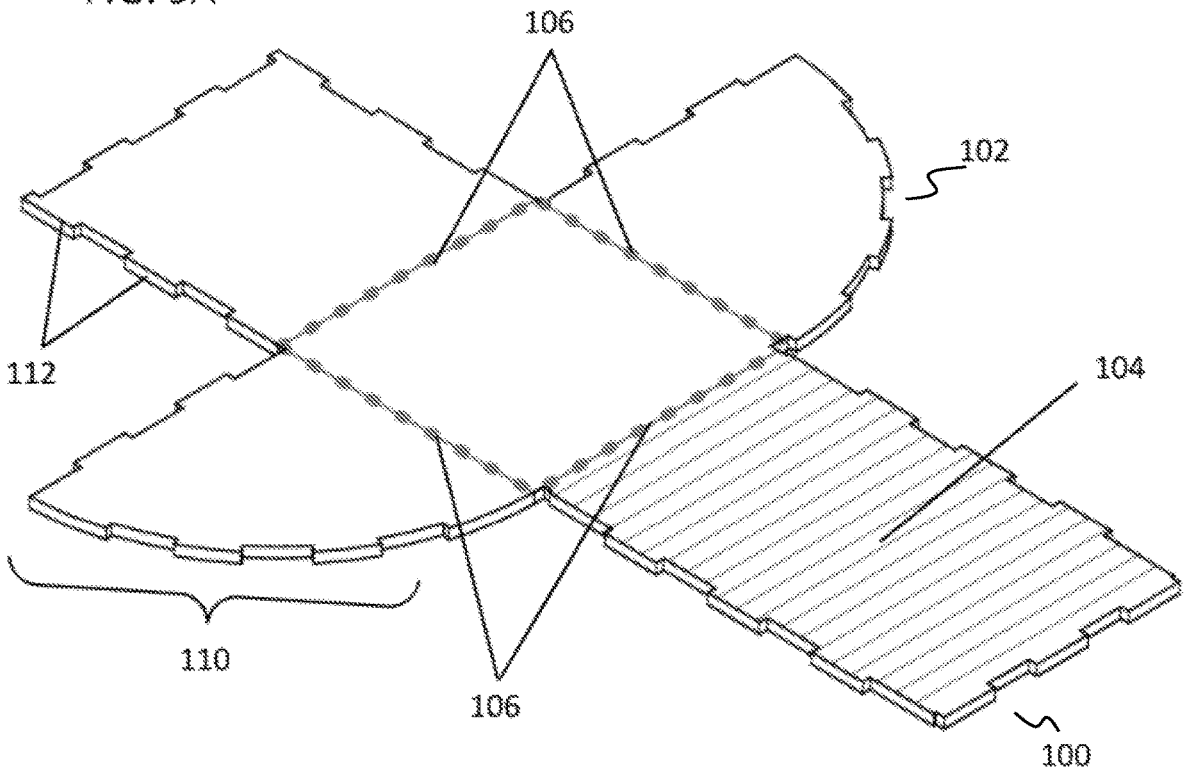
FIG. 9A illustrates a toy building unit that is a quarter cylinder in a flat position, according to some aspects of the disclosure.
Figure 9B:
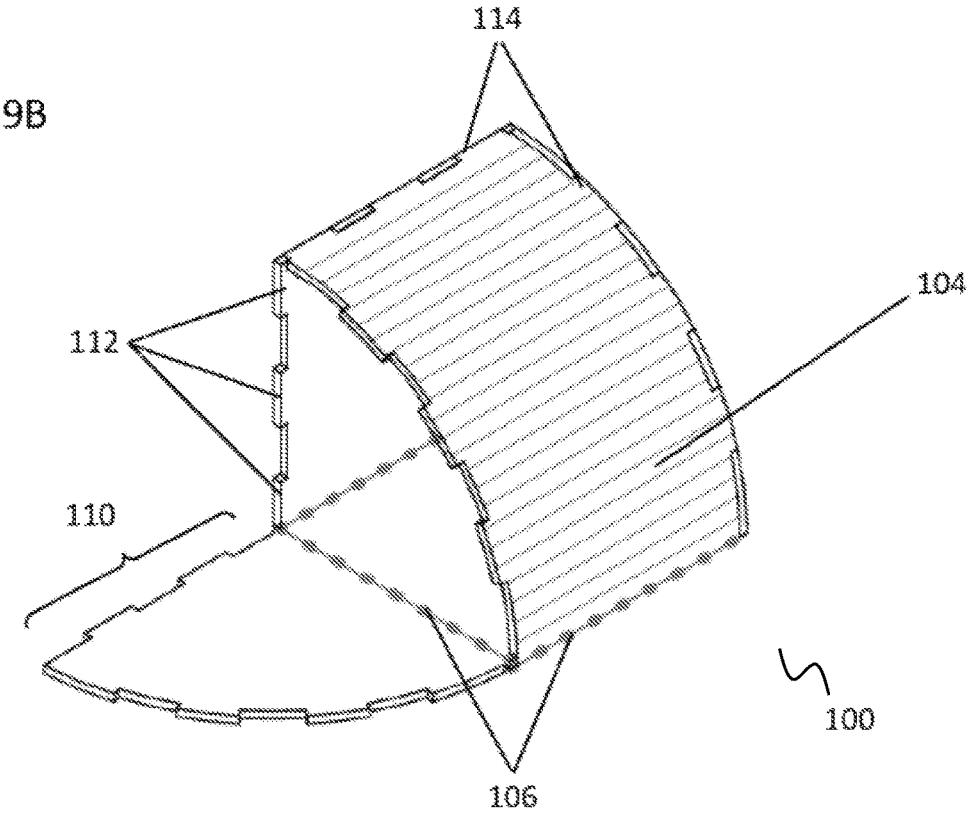
FIG. 9B illustrates a toy building unit that is partially constructed as a quarter cylinder in a three-dimensional hollow unit, according to some aspects of the disclosure.
Figure 10A:
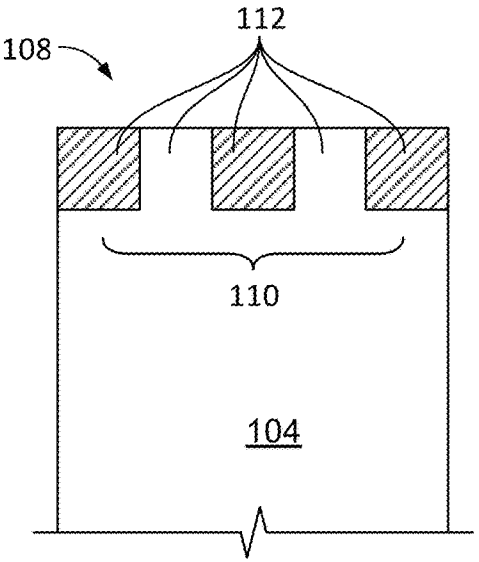
FIG. 10A illustrates interleaving teeth of two joins from the view of an outside surface of the toy building unit in a three-dimensional hollow position, according to some aspects of the disclosure.
Figure 10B:
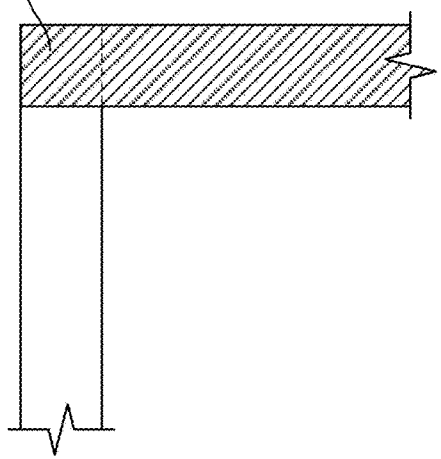
FIG. 10B illustrates a partial front view of joined joins, according to some aspects of the disclosure.
Figure 10C:
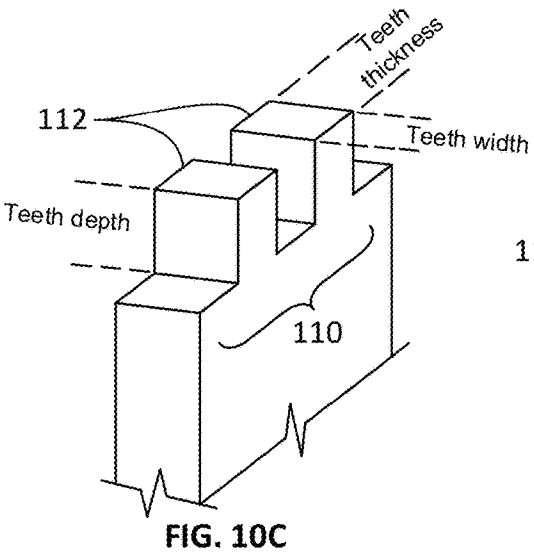
FIG. 10C illustrates an isometric view of un-joined join with two teeth, according to some aspects of the disclosure.
Figure 10D:
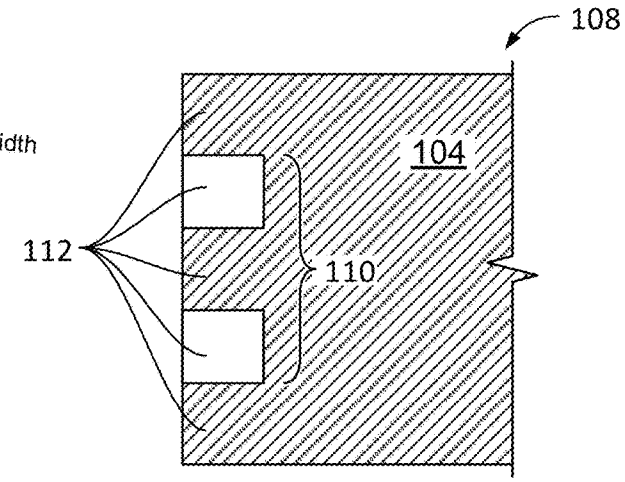
FIG. 10D illustrates interleaving teeth of two joins from the view of a top outside surface of the toy building unit in a three-dimensional hollow position, according to some aspects of the disclosure.

FIG. 9 illustrates a quarter cylinder building unit 100 in the flat position 102 and in a partially constructed position, according to some embodiments of the present disclosure. FIG. 9A illustrates a toy building unit in a flat position 102, according to some aspects of the disclosure. In some embodiments, the toy building unit 100 can include four hinges 106, as illustrated by dotted lines in FIG. 9A. In some embodiments, the toy building unit 100 can include no hinges 106. In some embodiments the toy building unit 100 can include a plurality of hinges 106. In some embodiments, the toy building unit 100 can include five sections 104 as shown in FIG. 9A. In some embodiments, the toy building unit 100 can include a plurality of sections 104. In some embodiments, the toy building unit 100 can include ten joins 110 as shown in FIG. 9A. In some embodiments, the joins can outline the sections 104 of the building unit in a flat position 102. In some embodiments, the toy building unit 100 can include a plurality of joins 110. In some embodiments, the join 110 can include teeth 112 as shown in FIG. 9. FIG. 9B illustrates a toy building unit 100 partially folded into a three-dimensional hollow unit, according to some aspects of the disclosure. In some embodiments, joins 110 of the building unit 100 can come together (e.g., interleave) and form an edge of the three-dimensional hollow building unit 114 as shown in FIG. 9B.

FIG. 10 illustrates example joins 110, for which the static friction can hold the building unit 100 together in a three-dimensional hollow position 108, according to some embodiments. FIG. 10A illustrates interleaving teeth 112 of two joins 110 from the view of an outside surface of the toy building 100 unit in a three-dimensional hollow position 108, according to some aspects of the disclosure. FIG. 10B illustrates a partial front view of joined joins 110, according to some aspects of the disclosure. In some embodiments, joins 110 can meet at right angles (90° angle), as shown in FIG. 10A-B and FIG. 10C. In some embodiments, the joins can meet at angles other than 90° angle. In some embodiments, joins can meet at about a 15° angle up to a 150° angle or any range or value between. FIG. 10C illustrates an isometric view of un-joined join 110 with two teeth 112, according to some aspects of the disclosure. FIG. 10D illustrates interleaving teeth 112 of two joins 110 from the view of a top outside surface of the toy building unit in a three-dimensional hollow position 108, according to some aspects of the disclosure. In some embodiments, interleaving teeth may enable friction to retain joins 110 such that the building unit 100 remains in a closed position, as shown partially in FIG. 10A and FIG. 10D. In some embodiments, the toy building unit 100 shown in FIG. 10 can be manufactured using cutting or molding processes described herein and known in the art.

Figures 11A, 11B, 11C, 11D, 11E:
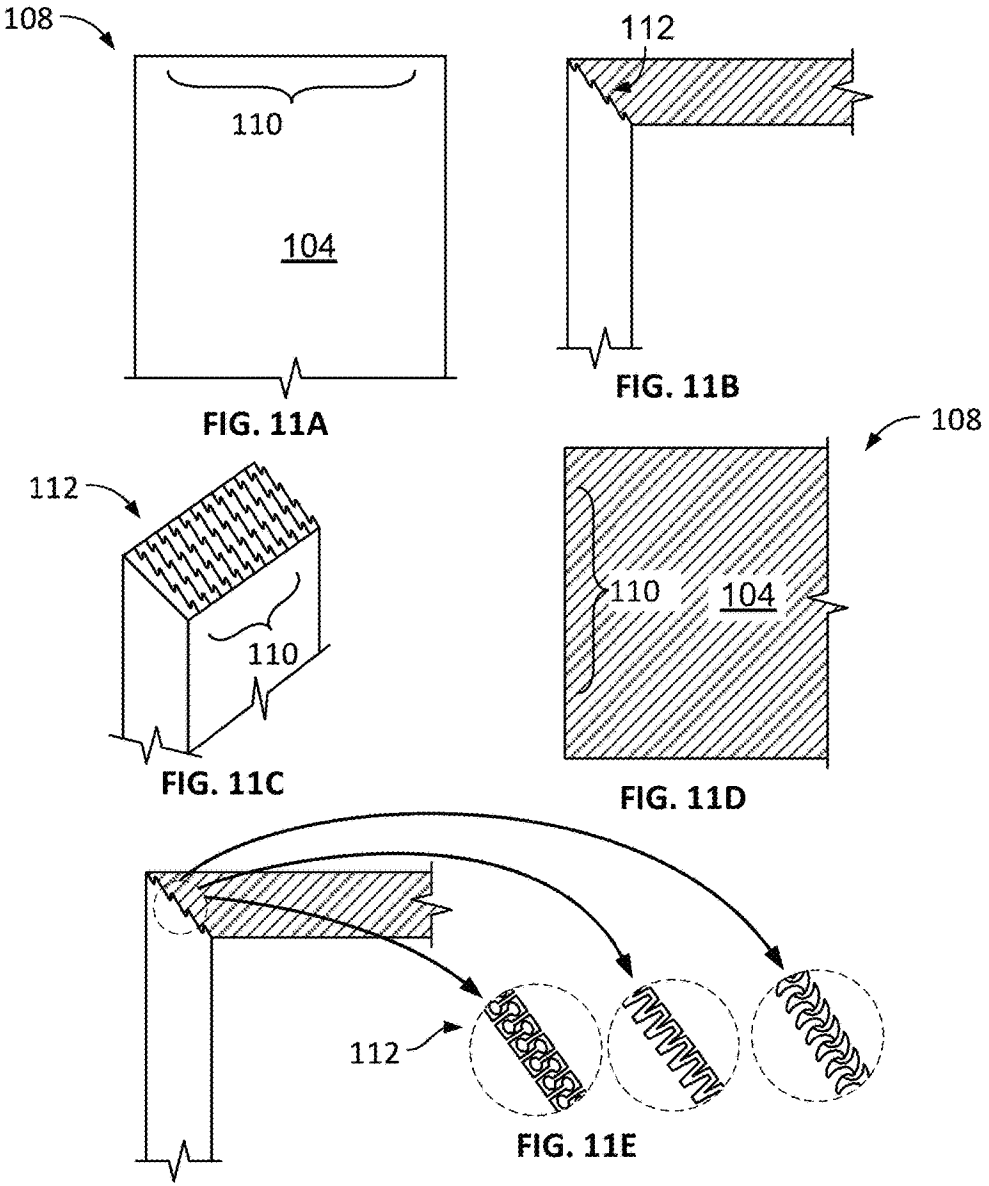
FIG. 11A illustrates interleaving two joins with a plurality of spike teeth from the view of an outside surface of the toy building unit in a three-dimensional hollow position, according to some aspects of the disclosure.
FIG. 11B illustrates a partial front view of two joined joins with a plurality of spike teeth, according to some aspects of the disclosure.
FIG. 11C illustrates an isometric view of un-joined join with a plurality of spike teeth, according to some aspects of the disclosure.
FIG. 11D illustrates two joined joins with a plurality of spike teeth interleaving from the view of a top surface of the toy building unit in a three-dimensional hollow position, according to some aspects of the disclosure.
FIG. 11E illustrates detailed interleaving of spike teeth, according to some aspects of the disclosure.
Figure 12A:
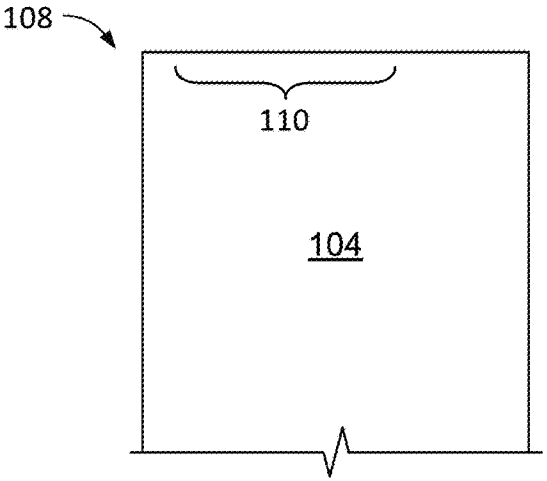
FIG. 12A illustrates two joined ridge joins from the view of an outside surface of the toy building unit in a three-dimensional hollow position, according to some aspects of the disclosure.
Figure 12B:
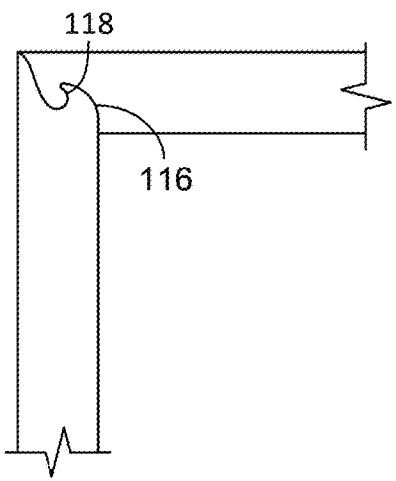
FIG. 12B illustrates a partial front view of two joined ridge joins, according to some aspects of the disclosure.
Figure 12C:
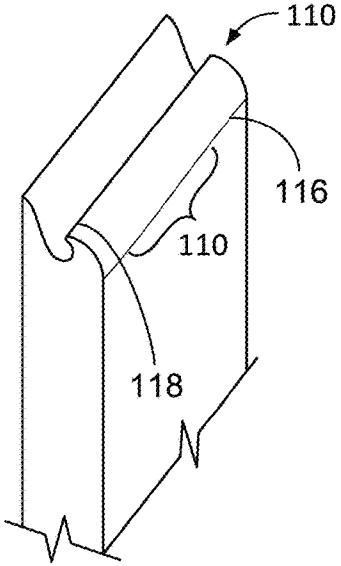
FIG. 12C illustrates an isometric view of un-joined ridge join with curved ridge instead of teeth, according to some aspects of the disclosure.
Figure 12E:
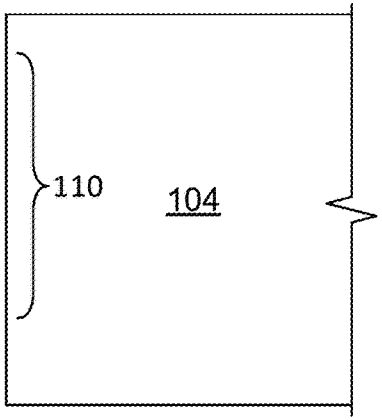
FIG. 12E illustrates joined curved ridge joins from a top outside view of the toy building unit in a three-dimensional hollow position, according to some aspects of the disclosure.
Figure 12D:
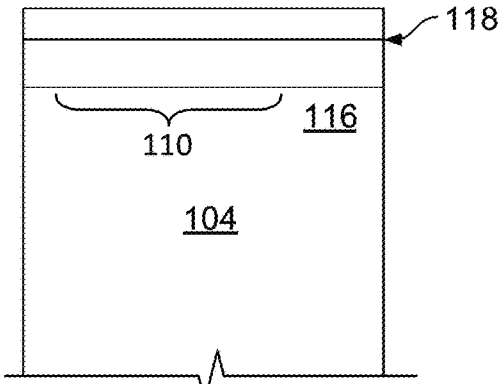
FIG. 12D illustrates a front view of an un-joined join with curved ridge instead of teeth, according to some aspects of the disclosure.

FIG. 11 illustrates example views of the toy building unit 100 with joins 110 that include a plurality of spike teeth 112 according to some embodiments of the present disclosure. FIG. 11A illustrates interleaving two joins 110 with a plurality of spike teeth 112 from the view of an outside surface of the toy building unit in a three-dimensional hollow position 108, according to some aspects of the disclosure. FIG. 11B illustrates a partial front view of two joined joins 110 with a plurality of spike teeth 112, according to some aspects of the disclosure. In some embodiments, interleaving teeth 112 are not visible from the view of the outside surface of the toy building unit in a three-dimensional hollow position 108, as shown in FIG. 11A. In some embodiments, the teeth 112 of two joins 110 of the building unit 100 can come together at multiple points, such that the interleaving teeth 112 are visible from a front view of interleaving joins 110, as illustrated in FIG. 11B. FIG. 11C illustrates an isometric view of un-joined join 110 with a plurality of spike teeth 112, according to some aspects of the disclosure. In some embodiments, the teeth 112 of the join 110 of the building unit 100 can be spikes, protrusions, jagged edges, barbs, catches, and the like (as shown in FIG. 11C and FIG. 11E), which can enable friction to retain joins 110 in a closed position. In some embodiments, styles of teeth 112 that include spikes, protrusions, jagged edges, barbs, catches, and the like can be manufactured using molding processes described herein and known in the art. FIG. 11D illustrates two joined joins 110 with a plurality of spike teeth interleaving from the view of a top surface of the toy building unit in a three-dimensional hollow position 108, according to some aspects of the disclosure. In some embodiments, interleaving teeth 112 are not visible from the top view of the toy building unit in a three-dimensional hollow position 108, as shown in FIG. 11D. FIG. 11E illustrates detailed interleaving of spike teeth 112, according to some aspects of the disclosure. Three interleaving spike designs are shown in cutout according to some non-limiting examples (FIG. 11E). In some embodiments, the teeth 112 may enable friction to retain joins 110 such that the building unit 100 remains in a closed position, as shown partially in FIG. 11A-B and FIG. 11D-E. In some embodiments, the toy building unit 100 shown in FIG. 11 can be manufactured using molding processes described herein and known in the art.

FIG. 12 illustrates a join with a curved ridge, which may enable joins 110 to be retained in a closed position by friction, by latching of overlapped ridges, or by a combination of friction and latching of overlapped ridges, according to some embodiments. In some embodiments, the join 110 of the building unit 100 can include an integral interleaving mechanism and no teeth 112, as shown in FIG. 12. In some embodiments, the join 110 of the building unit 100 can include an integral interleaving mechanism and teeth 112 (not shown). In some embodiments, an integral interleaving mechanism of a join 110 can include a ridge, as shown in FIG. 12. In some embodiments, the ridge can be curved as shown in FIG. 12. FIG. 12A illustrates two joined ridge joins 110 from the view of an outside surface of the toy building unit in a three-dimensional hollow position 108, according to some aspects of the disclosure. In some embodiments, interleaving joins 110 are not visible from the view of the outside surface of the toy building unit in a three-dimensional hollow position 108, as shown in FIG. 12A. FIG. 12B illustrates a partial front view of two joined ridge joins 110, according to some aspects of the disclosure. In some embodiments, the joins 110 with an integral interleaving mechanism can enable latching of opposing ridges which may retain joins in a closed position, as shown in FIG. 12B. FIG. 12C illustrates an isometric view of un-joined ridge join 110 with curved ridge instead of teeth 112, according to some aspects of the disclosure. In some embodiments, the curved ridge can be the integral interleaving mechanism. In some embodiments, the integral interleaving mechanism can include a first lip 116 and a second lip 118. In some embodiments, the space between the first lip 116 and the second lip 118 can be curved, as shown in FIG. 12C. FIG. 12D illustrates a front view of an un-joined join 110 with curved ridge instead of teeth 112, according to some aspects of the disclosure. In some embodiments, the curved ridge can be the integral interleaving mechanism. In some embodiments, the integral interleaving mechanism can include a first lip 116 and a second lip 118. In some embodiments, the first lip 116 can be slightly obscured when looking at the section 104 from a front view, as shown in FIG. 12D. In some embodiments, the second lip can be viewed when looking at the section 104 from a front view, as shown in FIG. 12D. FIG. 12E illustrates joined curved ridge joins 110 from a top outside view of the toy building unit in a three-dimensional hollow position 108, according to some aspects of the disclosure. In some embodiments, interleaving joins 110 are not visible from the top view of the toy building unit in a three-dimensional hollow position 108, as shown in FIG. 12E. In some embodiments, the toy building unit 100 shown in FIG. 12 can be manufactured using molding processes described herein and known in the art.

Figure 13C:
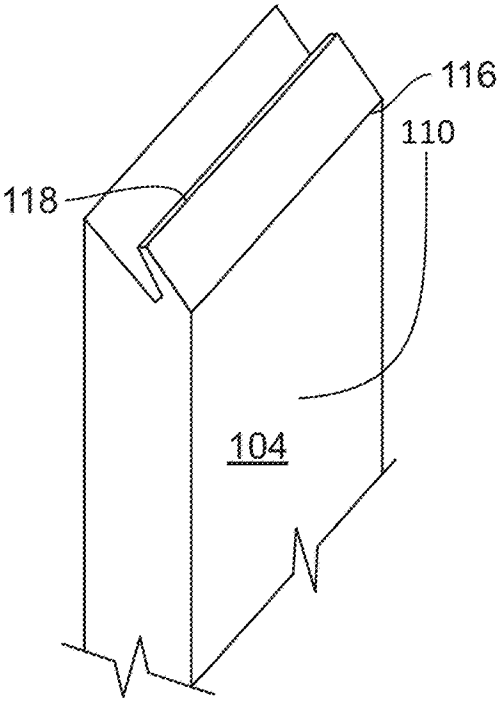
FIG. 13C illustrates an isometric view of un-joined join with angled ridge instead of teeth, according to some aspects of the disclosure.
Figure 13B:
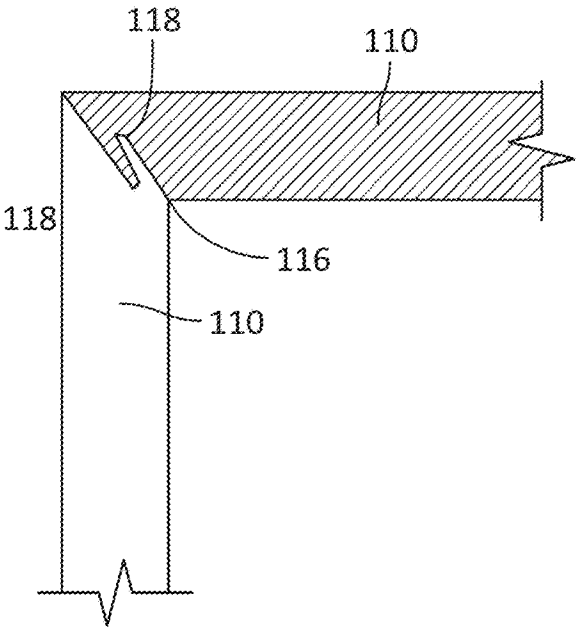
FIG. 13B illustrates a partial front view of joined joins with angled ridges, according to some aspects of the disclosure.
Figure 13A:
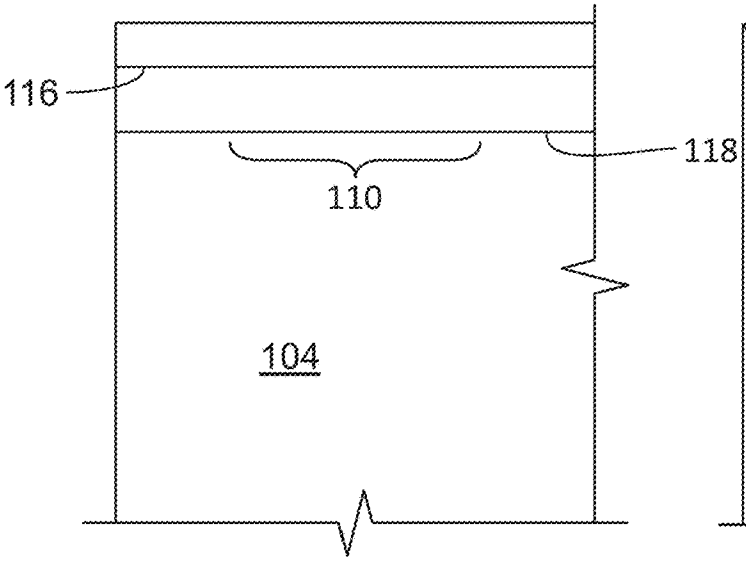
FIG. 13A illustrates a front view of an un-joined join with angled ridge instead of teeth, according to some aspects of the disclosure.

FIG. 13 illustrates a join with an angled ridge, which may enable latching ridges to retain joins 110 in a closed position according to some embodiments. In some embodiments, the join 110 of the building unit 100 can include an integral interleaving mechanism and no teeth 112, as shown in FIG. 13. In some embodiments, the join 110 of the building unit 100 can include an integral interleaving mechanism and teeth 112 (not shown). In some embodiments, an integral interleaving mechanism of a join 110 can include a ridge, as shown in FIG. 13. FIG. 13A illustrates a front view of an un-joined join 110 with angled ridge joins instead of teeth, according to some aspects of the disclosure. In some embodiments, the ridge can be angled as shown in FIG. 13. In some embodiments, the angled ridge can be the integral interleaving mechanism. In some embodiments, the integral interleaving mechanism can include a first lip 116 and a second lip 118. In some embodiments, the first lip 116 can be viewed when looking at the section 104 from a front view, as shown in FIG. 13A. In some embodiments, the second lip can be viewed when looking at the section 104 from a front view, as shown in FIG. 13A. FIG. 13B illustrates a partial front view of joined joins 110 with angled ridges, according to some aspects of the disclosure. In some embodiments, the joins 110 with an integral interleaving mechanism can enable latching of ridges which may retain joins in a closed position, as shown in FIG. 13B. FIG. 13C illustrates an isometric view of un-joined join 110 with angled ridge instead of teeth 112, according to some aspects of the disclosure. In some embodiments, the angled ridge can be the integral interleaving mechanism. In some embodiments, the integral interleaving mechanism can include a first lip 116 and a second lip 118. In some embodiments, the space between the first lip 116 and the second lip 118 can be angled, as shown in FIG. 13C. In some embodiments, the toy building unit 100 shown in FIG. 13 can be manufactured using molding processes described herein and known in the art.

FIG. 14A illustrates an example method of manufacturing the toy building unit, according to aspects of the disclosure.

FIG. 14B illustrates an example method of manufacturing the toy building unit, according to aspects of the disclosure.

ADDITIONAL EMBODIMENTS

An embodiment provides a toy building set that can include a building unit which is capable of folding from a flat position into a three-dimensional hollow position; the building unit can include a plurality of sections, wherein the plurality of sections can be delineated from and connected to at least one other section with a hinge that is integral to the building unit; a plurality of joins (which can be the outer edges of the building unit) outlining the building unit, wherein the joins can connect the sections of the building unit forming edges of the closed three-dimensional hollow building unit; and a closed position.

In some embodiments, the building unit can be cardboard. In some embodiments, the building unit can be bagasse. In some embodiments, the building unit can be wood. In some embodiments, the building unit can be laminate. In some embodiments, the building unit can be vellum. In some embodiments, the building unit can be rubber. In some embodiments, the building unit can be plasticized pulp. In some embodiments, the building unit can be a domed cuboid unit. In some embodiments, the domed cuboid unit can include five hinge and fourteen joins. In some embodiments, the fourteen joins, when closed, can form seven edges of the domed cuboid unit; and the five hinges can form five edges of the domed cuboid unit. In some embodiments, the building unit can be a half cylinder. In some embodiments, the half cylinder can include three hinge and six joins. In some embodiments, the six joins, when closed, can form three edges of the half cylinder; and the three hinges can form three edges of the half cylinder. In some embodiments, the building unit can be a quarter cylinder. In some embodiments, the quarter cylinder can include four hinge and ten joins. In some embodiments, the ten joins, when closed, can form five edges of the quarter cylinder; and the four hinges can form four edges of the quarter cylinder. In some embodiments, the closed position can include a flat surface created by a final closure. In some embodiments, the building unit can be laminated.

Another embodiment provides a method of manufacturing a toy building set, the method can include:

- cutting a building unit from a single sheeting material;
- forming, by a straight edge, a plurality of hinges whereby pressing the straight edge into the sheeting material forms the hinges; and
- forming, by cutting a plurality of joins.

In some embodiments, the building unit can be capable of folding from a flat position into a three-dimensional hollow position with the friction of connected joins. In some embodiments, the straight edge can crease score or cut score, the building unit to form the hinges. In some embodiments, the plurality of hinges can appear as a groove on one side of the building unit and a ridge on the opposite side of the building unit. In some embodiments, cutting can be die cutting, blade cutting, laser cutting, or combinations thereof. In some embodiments, the sheeting material can be cardstock, cardboard, plastic sheeting, bagasse sheeting, wood sheeting, pulp sheeting, plasticized pulp sheeting, laminates, and combinations thereof.

Another embodiment provides a method of manufacturing a toy building set, the method can include:

forming, by a molding process of a material, a building unit comprising:

a plurality of sections, wherein the plurality of sections are delineated from and connected to at least one other section with a hinge that is integral to the building unit; and a plurality of joins along the outer edges of the building unit, wherein each join comprises a plurality of teeth.

In some embodiments, the building unit can be capable of folding from a flat position into a three-dimensional hollow position with the friction of connected joins. In some embodiments, the molding process of a material can be injection molding. In some embodiments, the material can be a plastic, bioplastic, rubber, or combinations thereof. In some embodiments, the molding process of a material can be wet pressing, dry pressing, transfer molding, thermoforming, or combinations thereof. In some embodiments, the material can be paper pulp, bagasse pulp, hemp pulp, bamboo pulp, wood pulp, recycled pulp or combinations thereof. In some embodiments, the material can further comprise resins, wax, plastic, bioplastic, or combinations thereof.

CONCLUSION

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above-described embodiments In addition, it should be understood that any figures which highlight the functionality and advantages are presented for example purposes only. The disclosed methodology and system are each sufficiently flexible and configurable such that they may be utilized in ways other than that shown. In particular, the elements of any flowchart or process figures may be performed in any order and any element of any figures may be optional.

Although the term "at least one" may often be used in the specification, claims and drawings, the terms "a", "an", "the", "said", etc. also signify "at least one" or "the at least one" in the specification, claims and drawings. The terms "including" and "comprising" and any similar terms should be interpreted as "including, but not limited to" in the specification, claims and drawings.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

The invention claimed is:

1. A building unit of a toy building set, the building unit comprising:

at least two sections, wherein each section is connected to another section with at least one hinge, wherein a number of sections is equal to one plus a number of hinges, wherein the building unit is-configured to fold over multiple cycles at the at least one hinge from a flat position into a at least one open position or a closed position, wherein the closed position is a three-dimensional position with a hollow interior; wherein the hinges are configured as a groove on one surface of the building unit in the flat position and as ridges on an opposite surface of the building unit in the flat position;

wherein at least two joins integral to outer edges of the building unit in the flat position are configured to be brought together in pairs to form edges of the building unit in the closed position;

wherein the at least two joins have one or more integral teeth;

wherein the at least two sections, the at least one hinge, the at least two joins, and the one or more integral teeth are one piece;

wherein the one or more integral teeth of paired joins are configured to interleave to form a closed edge of the building unit in the closed position such that friction between surfaces of one or more interleaved teeth holds the building unit together in the closed position;

wherein a friction fit edge is configured to unpair by a pulling apart one or more interleaved teeth; and wherein in all positions of the building unit, the one or more integral teeth are configured to retain a fixed orientation relative to their integral join and their integral section.

2. The building unit of claim 1, wherein the building unit comprises cardstock, cardboard, bagasse, wood, laminate, plastic, vellum, rubber, plasticized pulp, pulp, or any combination thereof.

3. The building unit of claim 1, wherein the joins comprise curved or straight teeth.

4. The building unit of claim 1, wherein the building unit comprises a cuboid unit, and the cuboid unit comprises five hinges and fourteen joins.

5. The building unit of claim 1, wherein the building unit comprises a square based pyramid.

6. The building unit of claim 1, wherein the building unit comprises a triangular prism.

7. The building unit of claim 1, wherein the three-dimensional hollow building unit comprises a curved surface.

8. The building unit of claim 1, wherein the building unit is manufactured using a cutting process, a molded process, or combinations thereof.

9. The toy building unit of claim 1, wherein the joins connect the sections of the building unit forming edge connections without adhesive to create the three-dimensional hollow building unit.

10. The building unit of claim 1, wherein the building unit in the flat position has at least one point where two hinges meet two joins of a join pair; and wherein the one or more integral teeth of each join of the join pair are configured to interleave in a predetermined position.

11. The building unit of claim 10, wherein the predetermined position is a cuboid; and wherein a perimeter of the building unit in the flat position has at least one point where two hinges meet two joins at four right angles.

12. The building unit of claim 1, wherein the closed position is a predetermined polyhedron.

13. The building unit of claim 12, wherein the one or more interleaved teeth of the paired joins are configured to engage with each other to form the predetermined polyhedron in response to a fold at the at least one hinge from the flat position into the closed position.

14. The building unit of claim 1, wherein the outer edges of the building unit in the flat position are surfaces perpendicular to a top surface of the building unit in the flat position and perpendicular to a bottom surface of the building unit in the flat position.

15. The building unit of claim 1, wherein the one or more interleaved teeth in a paired join are configured to be visible on an exterior of the building unit in the closed position.

16. The building unit of claim 1, wherein the one or more integral teeth are an extension of a same material as the sections; wherein the one or more integral teeth, joins, and sections have a same thickness and are configured so that the building unit in the flat position may be formed by a die cutting through a sheet of material.

17. The building unit of claim 1, wherein each of the at least one hinge are partial cuts through a sheet of material; wherein the section, hinges, joins and one or more integral teeth are one piece of the same sheet of material.

* * * * *